US005698126A

United States Patent [19]

Morita et al.

[11] Patent Number: 5,698,126

[45] Date of Patent: Dec. 16, 1997

[54] MICROWAVE OVEN WITH FOOD WRAP FILM DETECTING FUNCTION

[75] Inventors: Mika Morita; Akira Okada, both of Nagoya; Teruya Tanaka, Yokohama; Hitoshi Takimoto, Fujisawa, all of Japan

[73] Assignee: Kabushiki Kaisha Toshiba, Kawasaki, Japan

[21] Appl. No.: 624,120

[22] Filed: Mar. 29, 1996

[30] Foreign Application Priority Data

Mar. 31, 1995 [JP] Japan ..... 7-076421

[51] Int. Cl.[6] ..... H05B 6/68

[52] U.S. Cl. ..... 219/704; 219/707; 219/708; 219/719; 99/325

[58] Field of Search ..... 219/707, 708, 219/702, 704, 719; 99/325, DIG. 14

[56] References Cited

U.S. PATENT DOCUMENTS 4,350,860 9/1982 Ueda ..... 219/707
4,484,065 11/1984 Ueda ..... 219/707
4,864,088 9/1989 Hiejima et al. ..... 219/707
4,874,928 10/1989 Kasai ..... 219/707

FOREIGN PATENT DOCUMENTS 64-23023 1/1989 Japan .

*Primary Examiner*—Philip H. Leung
*Attorney, Agent, or Firm*—Cushman Darby & Cushman IP Group of Pillsbury Madison & Sutro LLP

[57] ABSTRACT

A heating apparatus such as a microwave oven includes a magnetron supplying microwaves into a heating chamber so that food accommodated in it is heated and a microcomputer-based control circuit. The control circuit discriminates the food among three conditions, that is, a first condition in which the food is not wrapped in a wrap film, a second condition in which the food is wrapped in a wrap film, and a third condition belonging neither to the first nor to the second condition. Based on the results of discrimination, the control circuit calculates a remaining heating time.

11 Claims, 18 Drawing Sheets

FIG. 9
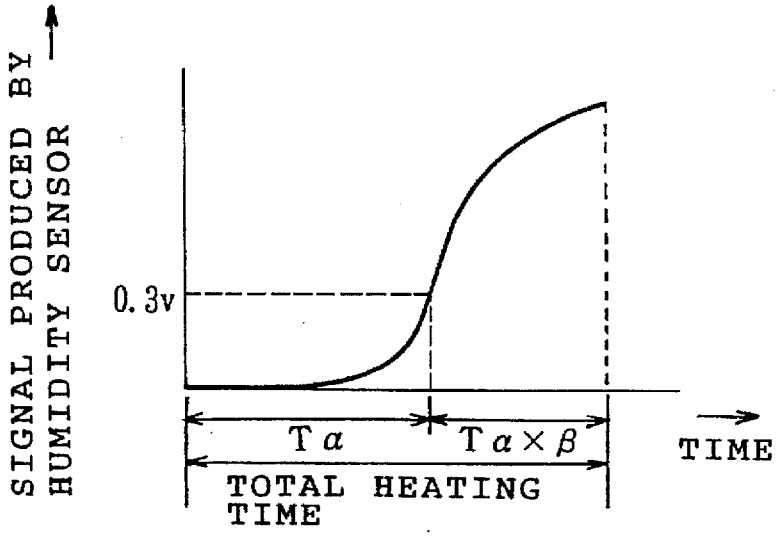
FIG. 10
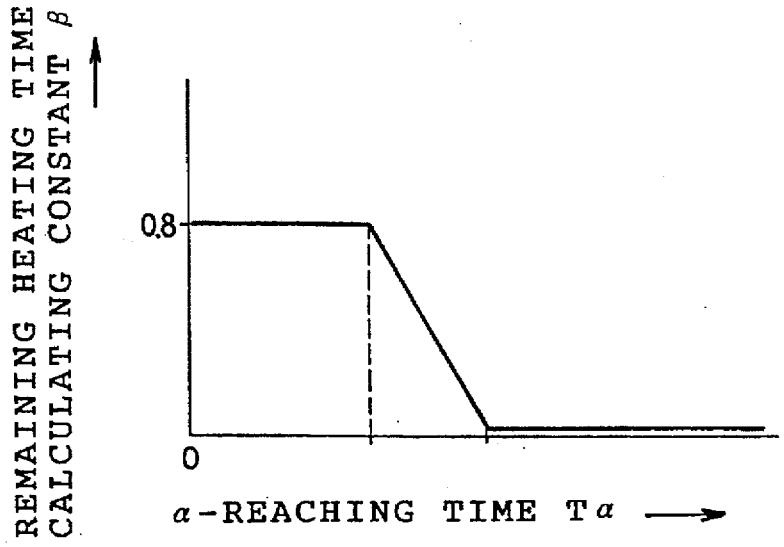
FIG. 11A
FIG. 11B
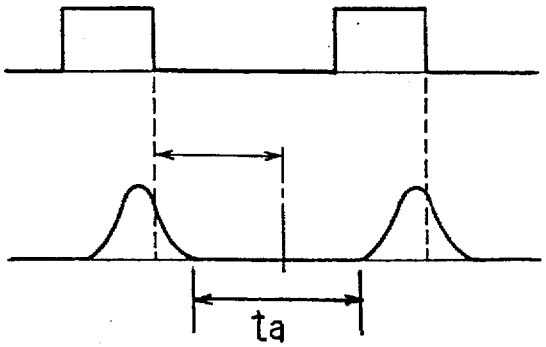

MICROWAVE OVEN WITH FOOD WRAP FILM DETECTING FUNCTION

BACKGROUND OF THE INVENTION

1. Field of the Invention

This invention relates to a heating apparatus such as microwave ovens including a magnetron supplying microwaves to a heating chamber so that food accommodated therein is heated.

2. Description of the Prior Art

A heating apparatus of the above-described type or a microwave oven comprises a gas sensor for sensing a gas emanating from food, for example, steam. A heating period of time is determined on the basis of an output of the gas sensor so that the heating is automatically executed. An amount of emanating gas differs between food wrapped in a wrap film and food not wrapped in a food wrap film even when the foods are the same. Accordingly, when the automatic heating is executed on the basis of the output of the gas sensor, it is necessary to previously determine, for every type of food or cooking menu, whether the food is wrapped in a wrap film or not. For this purpose, an instruction manual for the microwave oven or a cookbook contains detailed instructions about the heating of every type of food or cooking menu both when the food is wrapped in a wrap film and when the food is not wrapped in a wrap film.

In the above-described microwave oven, however, a user needs to consult or refer to the instruction manual or the cookbook to make sure that the food needs to be wrapped in a wrap film and that the food should not be wrapped in the wrap film, every time the automatic heating is executed. The reference to the instruction manual or the cookbook at every time of the heating is troublesome. Furthermore, contrary to the instructions in the instruction manual or the cookbook, when food is wrapped in a wrap film or is not wrapped in a wrap film, a detection timing of the gas sensor is rendered improper. Such an improper detection timing results in insufficient heating or excessive heating.

SUMMARY OF THE INVENTION

Therefore, an object of the present invention is to provide a heating apparatus in which a proper heating can be automatically executed both when food is wrapped in a wrap film and when the food is not wrapped in the wrap film, so that the usability of the apparatus can be improved.

The present invention provides a heating apparatus comprising a heating chamber, a magnetron for supplying microwaves to the heating chamber so that food accommodated in the heating chamber is heated, detecting means for detecting an absolute humidity in the heating chamber or a gas emanating from the food, wrap film discrimination means, connected to the detecting means, to measure a time T between initiation of a heating operation and a time an output of the detecting means reaches a predetermined wrap film discrimination value for discriminating with respect to the food accommodated in the heating chamber among a first condition when the measured time T is equal to or below a first wrap film discrimination time T1, a second condition when the measured time T is above the first wrap film discrimination time T1 and at or below a second wrap film discrimination time T2, and a third condition when the measured time T is above the second wrap film discrimination time T2, the first and second wrap film discrimination times T1 and T2 having a relationship of inequality $T1<T2$, the first condition corresponding to a condition in which the food is not wrapped in a wrap film, the second condition corresponding to a condition in which the food is wrapped in a wrap film in such an incomplete manner that a gas emanating from the food is likely to leak outside the wrap film, the third condition corresponding to a condition in which the food is completely wrapped in a wrap film, control means, connected to the magnetron, the detecting means and the wrap film discrimination means, for controlling the magnetron to thereby control a heating operation, the control means having a function of executing the heating operation according to any one of the first to third conditions of the food discriminated by the wrap film discrimination means after the magnetron is driven so that the heating operation is initiated. The heating apparatus may further comprise remaining heating time for calculating a remaining heating time in accordance with any one of the first, second, and third conditions of the food determined by the wrap film discrimination means, the remaining heating time in accordance with the first condition being longest of the three, the remaining heating time in accordance with the third condition being shortest of the three, the remaining heating time in accordance with the second condition being intermediate between the remaining heating times in accordance with the first and third conditions.

According to the above-described heating apparatus, the food accommodated in the heating chamber is automatically determined to be in any one of the first to third conditions by the wrap film discrimination means. The remaining heating time is calculated on the basis of the results of discrimination. Consequently, a proper heating operation can be automatically executed both when the food is wrapped in a wrap film and when it is not wrapped in a wrap film. Thus, since a user may or may not use a wrap film without relying upon the instruction manual or cookbook, the usability of the microwave oven can be improved. Furthermore, the second of the three conditions relates, for example, to a situation where the food is half or incompletely wrapped in a wrap film such that an amount of gas emanating from the food in the second condition differs from those in the first and third conditions. The second condition thus compensates for differences in the manner in which food is wrapped in a wrap film, for example. In this arrangement, the heating can be accurately controlled even when the manner of wrapping the food in a wrap film differs from one case to another. Consequently, a more appropriate heating operation can be executed.

The heating apparatus may further comprise time setting means for setting an excessive heating preventing heating time for preventing the food from being excessively heated. Even if the wrap film discrimination means should fail to determine whether a wrap film is present or absent, the heating operation would be automatically terminated upon lapse of the excessive heating preventing heating time. Consequently, the food can be prevented from being excessively heated. Furthermore, the heating apparatus may further comprise weight detecting means for detecting a weight of the food or weight data inputting means for inputting data indicative of the weight of the food. In this arrangement, the time setting means may set the excessive heating preventing heating time in accordance with the weight of the food detected by the weight detecting means or the data indicative of the weight of the food inputted by the weight data inputting means. Even if the wrap film discrimination means should fail to determine about the presence or absence of a wrap film, the heating operation would be automatically terminated upon lapse of the excessive heating preventing heating time. Consequently, the food can be prevented from being excessively heated.

The wrap film discrimination means may comprise a humidity sensor for detecting an absolute humidity in the heating chamber or a gas sensor for detecting a gas emanating from the food. The wrap film discrimination means may measure a period of time between initiation of a heating operation and a time an output of the humidity sensor or the gas sensor reaches a predetermined wrap film discrimination value. The wrap film discrimination means may determine that the food is in the second condition, when the measured time exceeds a predetermined wrap film discrimination time. Consequently, an exact determination can be made about the presence or absence of a wrap film. Furthermore, the wrap film discrimination means may determine that the food is in the first condition, when an output of the humidity sensor or the gas sensor exceeds a set value for wrap film discrimination at a time a set time after initiation of a heating operation. Consequently, an exact and reliable determination can be made about the presence or absence of a wrap film.

The remaining heating time calculating means may calculate the remaining heating time by multiplying a time $T_\alpha$ by a remaining heating time calculating constant $\beta$, the time $T_\alpha$ being required for an output of the humidity sensor or the gas sensor to reach a remaining heating time calculating set value $\alpha$ from the initiation of the heating operation. Consequently, the remaining heating time can be precisely calculated. In this case, the control arrangement can be simplified when the wrap film discrimination value is rendered equal to the remaining heating time calculating set value $\alpha$.

The remaining heating time can be calculated further precisely when the remaining heating time calculating constant $\beta$ is set on the basis of the results of discrimination by the wrap film discrimination means. Furthermore, the presence or absence of a wrap film can be accurately detected irrespective of an amount of food, and the remaining heating time can be precisely calculated when at least one of the wrap film discrimination time, the remaining heating time calculating set value $\alpha$, and the remaining heating time calculating constant $\beta$ is varied in accordance with the weight of the food. Furthermore, in the case where the remaining heating time calculating constant B is set at zero when the wrap film discriminating means has determined that the food is in the second condition, the heating operation can be terminated immediately when the food is determined to be in the second condition.

The wrap film discriminating means may discriminate with respect to the food accommodated in the heating chamber among a first condition in which the food is not wrapped in a wrap film, a second condition in which the food is wrapped in a wrap film, and a third condition belonging neither to the first or to the second condition. The third condition may include, for example, a case where the food is half or incompletely wrapped in a wrap film such that an amount of gas emanating from the food in the third condition differs from those in the first and second conditions. The third condition may thus cover the differences in the manner of wrapping food in a wrap film, for example. In this arrangement, the heating can be accurately controlled even when a manner of wrapping the food in a wrap film differs from one case to another. Consequently, a further proper heating operation can be executed. Furthermore, a further suitable heating time can be obtained when the microwave oven further comprises remaining heating time calculating means for calculating a remaining heating time in accordance with any one of the first, second, and third conditions of the food determined by the wrap film discrimination means. Furthermore, the microwave oven may further comprise time setting means for setting an excessive heating preventing heating time for preventing the food from being excessively heated. Even if the wrap film discrimination means should fail to determine about the presence or absence of a wrap film, the heating would be automatically terminated upon lapse of the excessive heating preventing heating time. Consequently, the food can be prevented from being excessively heated.

In the above-described arrangement, too, the detecting means may comprise a humidity sensor for detecting an absolute humidity in the heating chamber or a gas sensor for detecting a gas emanating from the food. discrimination value. The wrap film discrimination means may determine that the food is in the first condition, when the measured time T is at or below a predetermined first wrap film discrimination time T1. The wrap film discrimination means may determine that the food is in the second condition, when the measured time T exceeds a predetermined second wrap film discrimination time T2. The wrap film discrimination means may determine that the food is in the third condition, when the measured time T is above the first wrap film discrimination time T1 and at or below the second wrap film discrimination time T2. Consequently, the food can be accurately discriminated among the three conditions with respect to the manner of wrapping the same in a wrap film.

In the above-described arrangement, the heating apparatus may further comprise means for measuring a time $T_\alpha$ between the initiation of the heating operation and a time when an output of the detecting means reaches a remaining heating time calculating set valve $\alpha$ and remaining heating time calculating means for calculating a remaining heating time by multiplying the measured time $T_\alpha$ by a remaining heating time calculating constant $\beta$. Three remaining heating time calculating constants $\beta 1$, $\beta 2$, and $\beta 3$ corresponding to the first, second, and third conditions of the food respectively may be set to effect the relation shown by $\beta 3<\beta 2<\beta 1$. Consequently, since the difference among the constants $\beta 1$, $\beta 2$ and $\beta 3$ can be rendered larger depending upon the presence or absence of a wrap film, the remaining heating time $T_n$ can be further precisely calculated in accordance with the differences in the manner of wrapping the food in a wrap film. Furthermore, the remaining heating time calculating constant $\beta$ may be varied in accordance with the measured time $T_\alpha$. For example, when the constant $\beta$ is rendered small as the time $T_\alpha$ becomes longer, the remaining heating time can be further precisely calculated.

The heating apparatus may further comprise weight detecting means for detecting a weight of the food or weight data inputting means for inputting data indicative of the weight of the food. The time setting means may set the excessive heating preventing heating time in accordance with the weight of the food detected by the weight detecting means or the data indicative of the weight of the food inputted by the weight data inputting means. For example, when the excessive heating preventing heating time is set stepwise in accordance with divisions of the weight of the food, the food can be further prevented from being excessively heated irrespective of the differences in the weight of the food or the differences in the manner of wrapping the food in a wrap film. Furthermore, the heating apparatus may further comprise operation control means for terminating the heating operation when an output produced by the detecting means has reached a maximum output limit value. In this arrangement, too, the food can be further prevented from being excessively heated. The maximum output limit value may be varied in accordance with the results of discrimination by the wrap film discrimination means.

An output of the humidity sensor or the gas sensor is preferably input in a period during which a drive voltage is not applied to the magnetron. Consequently, an electrical noise resulting from oscillation of the magnetron can be prevented from being superimposed on the output of the sensor. This provides a further accurate heating control. In this case, the output of the humidity sensor or the gas sensor is preferably input at a plurality of times in the period wherein the drive voltage is not applied to the magnetron, and a mean value of the input outputs is obtained.

BRIEF DESCRIPTION OF THE DRAWINGS

Other objects, features and advantages of the present invention will become clear upon reviewing the following description of preferred embodiments thereof, made with reference to the accompanying drawings, in which:

FIG. 9 is a graph of a characteristic curve showing the variation in the voltage level of the signal produced by the humidity sensor and a manner of calculation of a remaining heating time;

FIG. 10 is a graph showing the relation between a remaining heating time calculating constant β and the results of determination about the presence or absence of a wrap film;

FIGS. 11A and 11B are time charts of a time base signal and waveforms of a drive voltage applied to a magnetron respectively;

DETAILED DESCRIPTION OF THE PREFERRED EMBODIMENTS

Figure 1:
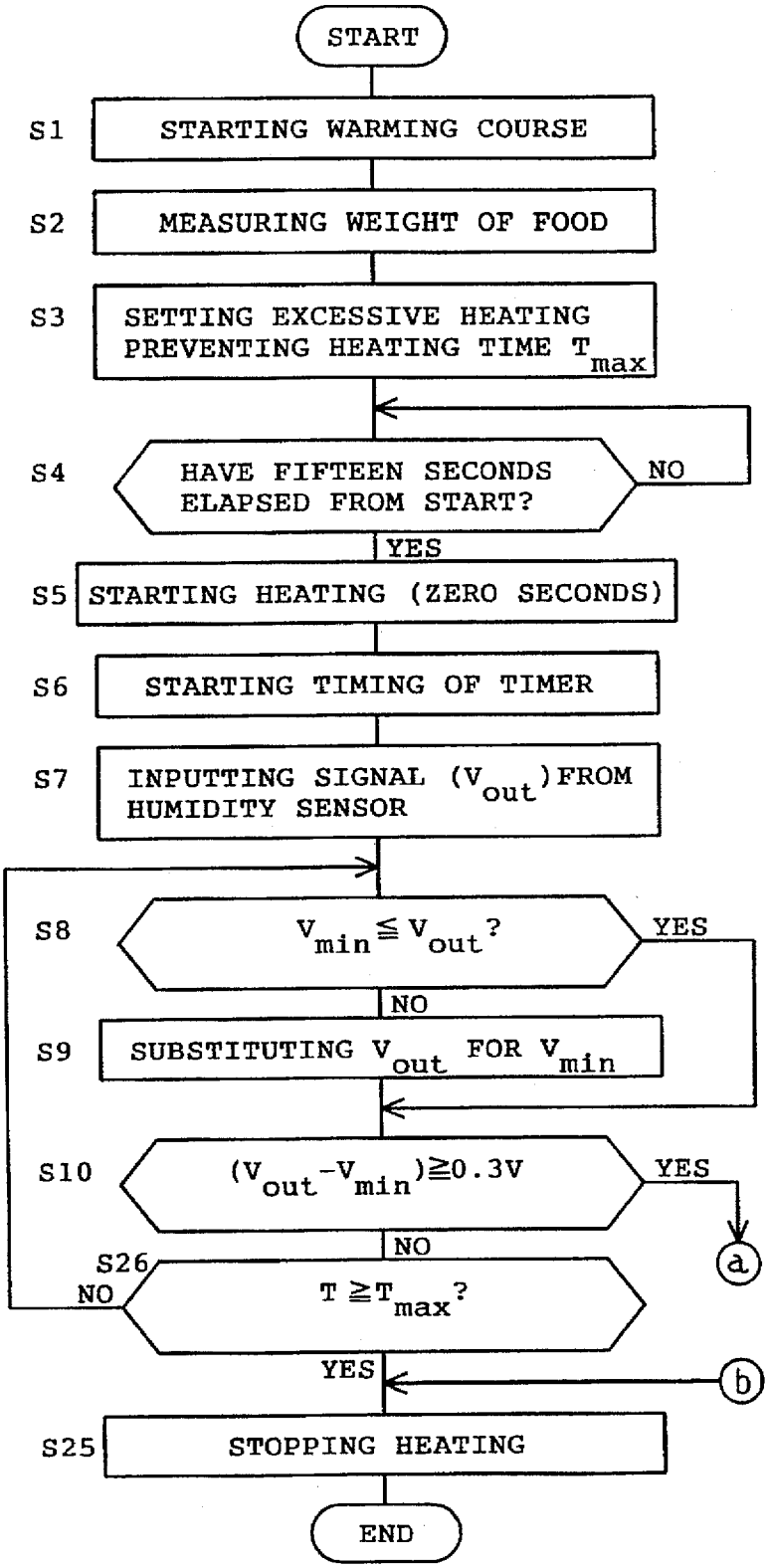
FIG. 1 is a flowchart explaining the operation of a control circuit incorporated in a microwave oven of a first embodiment in accordance with the present invention.
Figure 2:
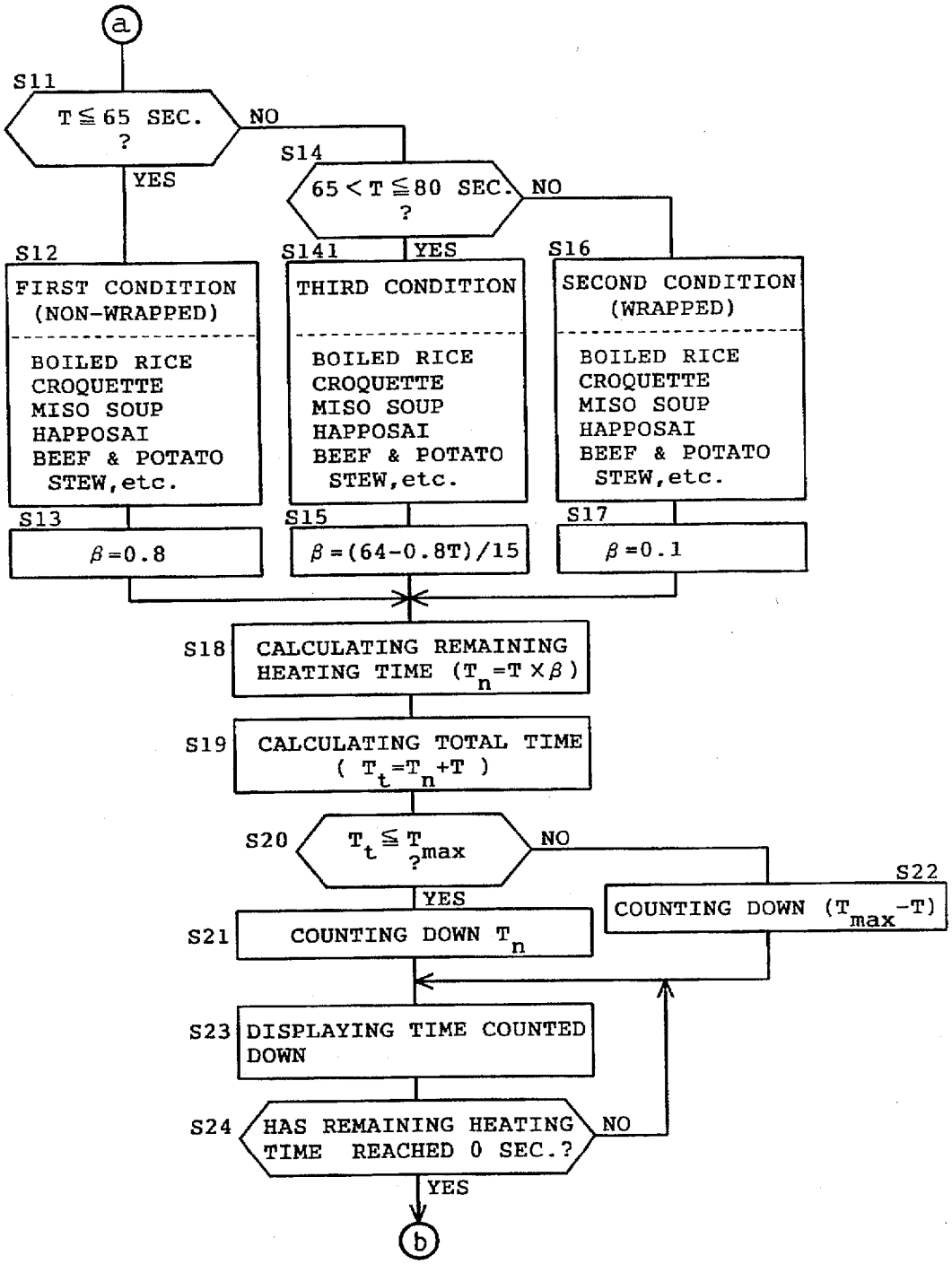
FIG. 2 is also a flowchart explaining the operation of the control circuit continued from FIG. 1.
Figure 3:
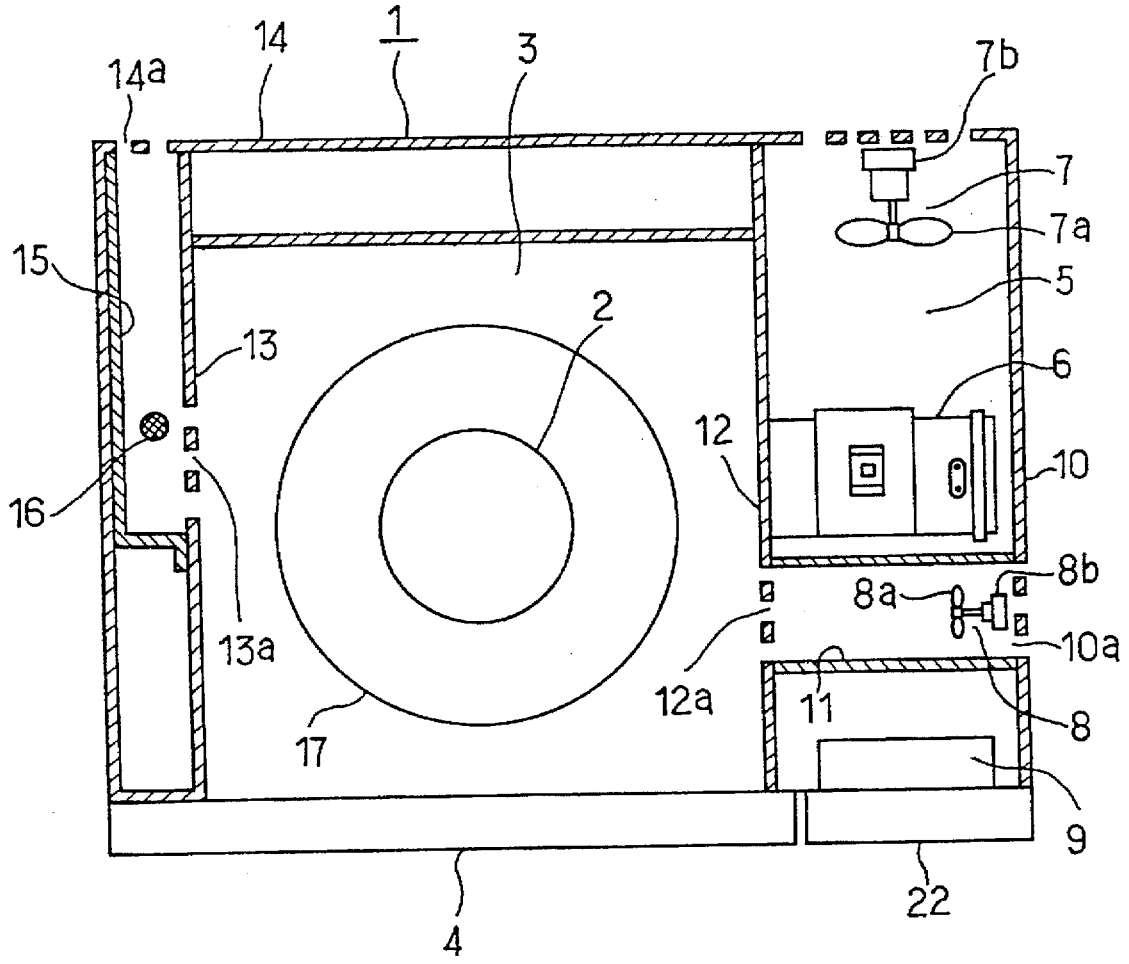
FIG. 3 is a transverse section of the microwave oven.
Figure 4:
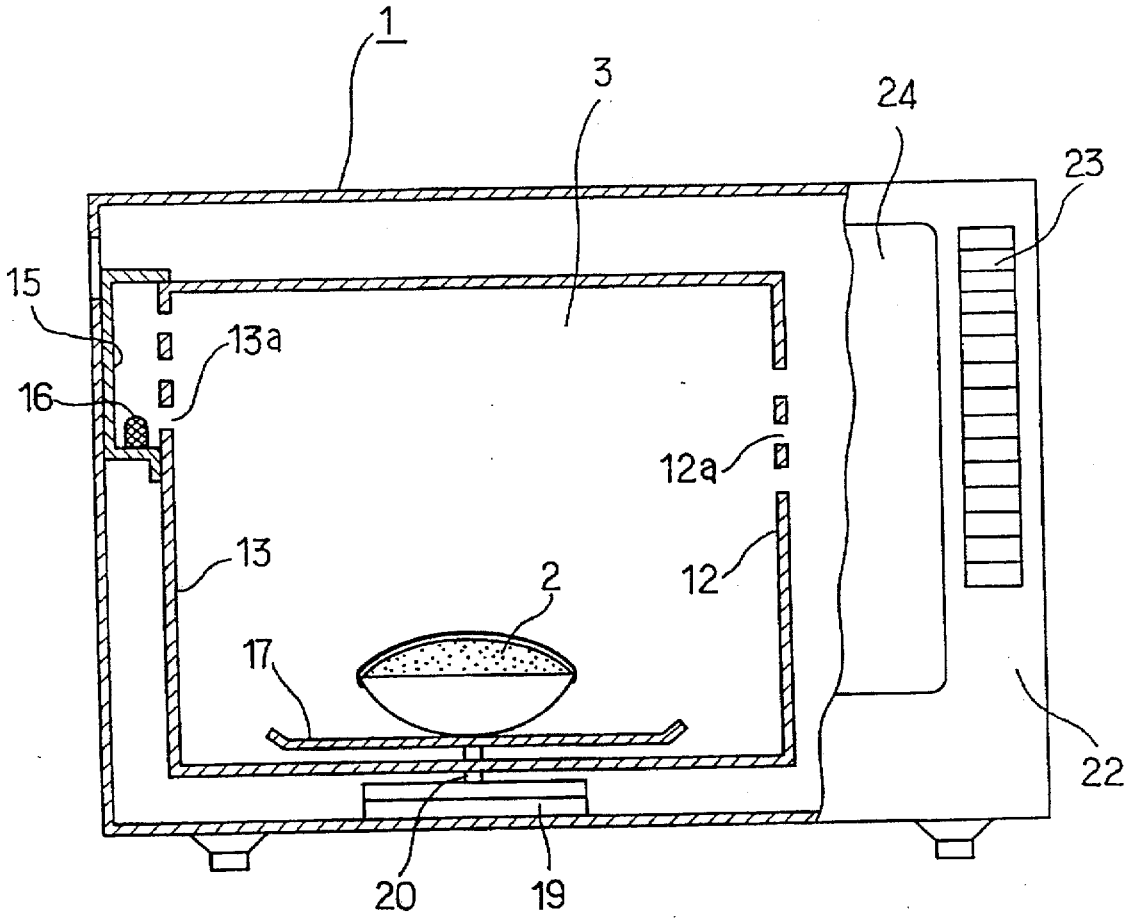
FIG. 4 is a broken front view of the microwave oven.

A first embodiment of the present invention will be described with reference to FIGS. 1 to 12. Referring first to FIGS. 3 and 4, a microwave oven of the first embodiment in accordance with the present invention is shown. A body 1 of the microwave oven includes a heating chamber 3 in which food 2 is accommodated to be heated. The heating chamber 3 has a front opening through which the food 2 is put into and taken out of the heating chamber 3. A door 4 is mounted to open and close the opening of the heating chamber 3. An equipment compartment 5 is provided on the right of the heating chamber 3, as is viewed in FIG. 3. The equipment compartment 5 accommodates therein a magnetron 6, a cooling fan unit 7 for cooling the magnetron 6, a blowing fan unit 8 for supplying outside air into the heating chamber 3, a control circuit unit 9, an electric power supply circuit (not shown) for supplying driving electric power to the magnetron 6, and so on.

The magnetron 6 supplies microwaves into the heating chamber 3 through a waveguide (not shown), so that the food 2 is high-frequency heated. The cooling fan unit 7 comprises a fan 7*a* and a fan motor 7*b* driving the fan 7*a*. The blowing fan unit 8 also comprises a fan 8*a* and a fan motor 8*b* driving the fan 8*a*. The blowing fan unit 8 is adapted to draw in outside air through a vent 10*a* having a number of small holes formed in a right-hand wall 10 of the oven body 1. The outside air drawn through the intake 10*a* is supplied into the heating chamber 3 through a duct 11 and a vent 12*a* having a number of small holes formed in the right-hand wall 12, as viewed in FIG. 3.

A vent 13*a* having a number of small holes is formed in the upper portion of a left-hand wall 13 of the heating chamber 3, as viewed in FIG. 3. An exhaust duct 15 is disposed outside the air outlet 13*a* to communicate between the same and an outlet 14*a* having a number of small holes formed in the rear wall of the oven body 1. Air in the heating chamber 3 is exhausted outside the oven body 1 through the vent 13*a*, the exhaust duct 15, and the outlet 14*a* when the blowing fan unit 8 is driven to supply outside air into the heating chamber 3.

A humidity sensor 16 is provided in the exhaust duct 15 for detecting an absolute humidity in the heating chamber 3, thereby producing a humidity signal. The humidity sensor 16 is adapted to detect the absolute humidity of the air passing through the exhaust duct 15 or the absolute humidity in the heating chamber 3, thereby detecting an amount of steam produced by the food 2. The humidity sensor 16 will be described in detail later.

Figure 5:
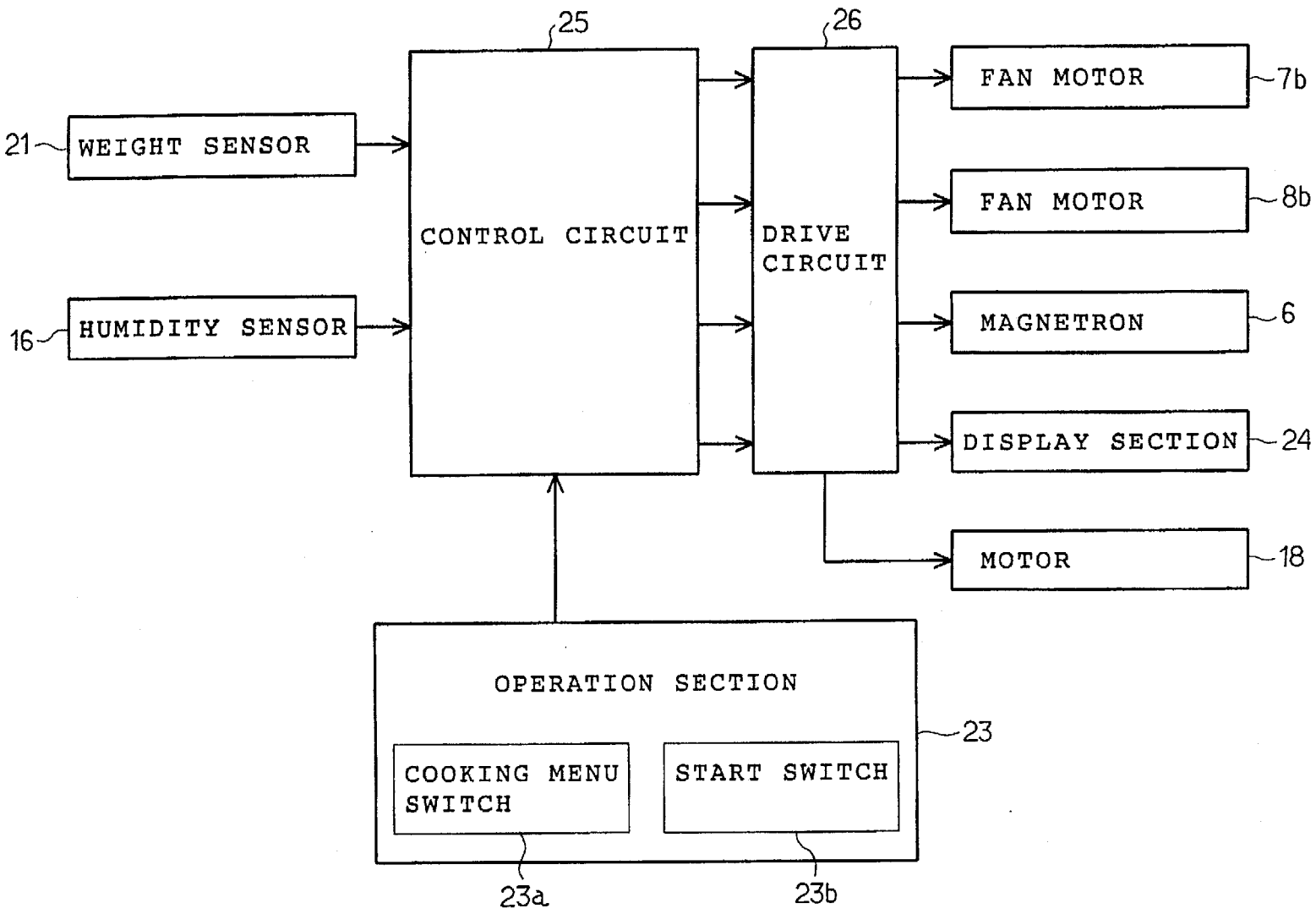
FIG. 5 is a block diagram showing an electrical arrangement of the microwave oven.

A turntable 17 on which the food 2 is to be placed is mounted on the bottom of the heating chamber 3 for rotation. The turntable 17 is rotated via a rotational shaft 20 by a drive mechanism 19 incorporating an electric motor 18, as is shown in FIGS. 4 and 5. A weight sensor 21 of the electrical capacitance type, for example, is provided in the drive mechanism 19 for detecting the weight of the food 2 placed on the turntable 17. The weight sensor 21 is adapted to produce a signaling frequency corresponding to a load (or the weight of the food 2) acting on the rotational shaft 20, the signaling frequency serving as a weight signal.

An operation panel 22 is mounted on the front right-hand end portion of the oven body 1. The operation panel 22 includes an operation section 23 comprising various switches and a display section 24 which comprises various displays and serves as display means. The above-mentioned switches include a cooking menu switch 23*a* for selecting one of cooking menus, a start switch 23*b*, and a switch for setting the magnitude of heating output power, as shown in FIG. 5. The above-mentioned displays include a display for displaying the cooking menus, a display for displaying time, a heating time, and a remaining heating time, and a display for displaying a heating output power. The display displaying the remaining heating time has a function of displaying the remaining heating time, counting down the same second by second or minute by minute.

Referring to FIG. 5 showing an electrical arrangement of the microwave oven, a control circuit 25 comprising a microcomputer has a function of controlling the whole heating operation of the microwave oven. The control circuit 25 includes a memory for storing a control program for the controlling function thereof. The control circuit 25 serves as wrap film discrimination means, remaining heating time calculating means, time setting means, and operation control means.

The control circuit 25 is adapted to receive various switch signals from the operation section 23, the humidity signal from the humidity sensor 16, and the weight signal from the weight sensor 21. Furthermore, the control circuit 25 controls via a drive circuit 26 the magnetron 6, the fan motor 7*a* of the cooling fan unit 7, the fan motor 8*a* of the blowing fan unit 8, the display section 24, and the motor 18.

Figure 6:
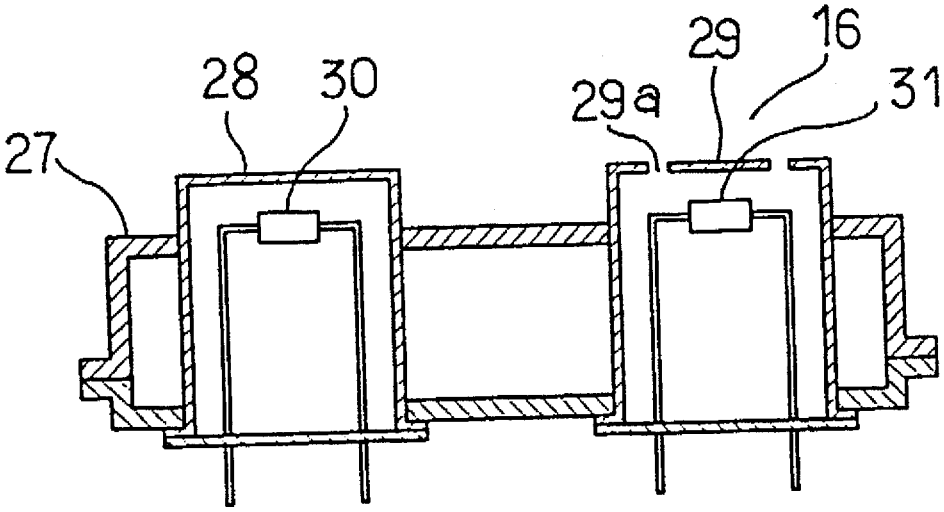
FIG. 6 is a sectional view of a humidity sensor employed in the microwave oven.
Figure 7:
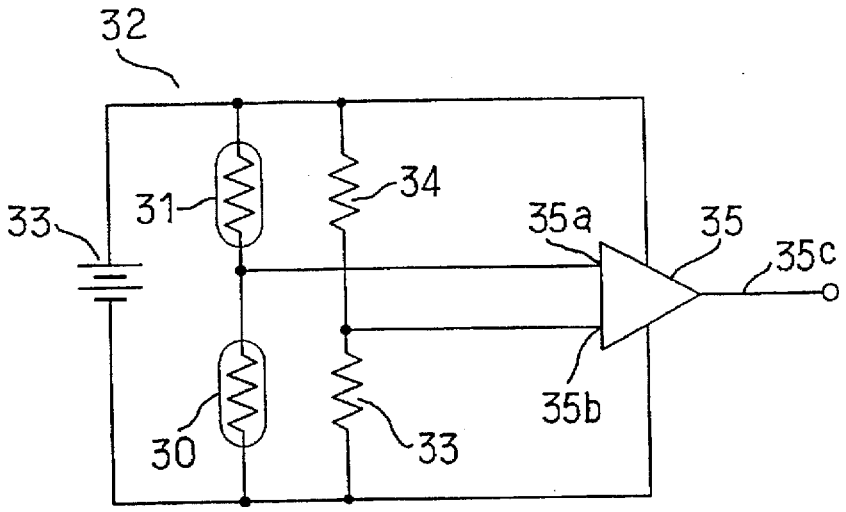
FIG. 7 is an electrical circuit diagram of a humidity detection circuit.

Referring to FIGS. 6 and 7, the humidity sensor 16 will be described in detail. The humidity sensor 16 comprises a first or temperature compensation section 28 and a second or humidity-sensitive section 29 both mounted on a sensor casing 27. The first section 28 comprises a first thermistor 30 provided therein and is sealed so as to contain therein dried air. The second section 29 comprises a second thermistor 31 provided therein and has vent holes 29*a* formed in the upper wall thereof, as viewed in FIG. 6. Air is allowed to flow through the vent holes 29*a* to the interior of the second section 29. In detection of the humidity, heat is applied to both of the thermistors 30 and 31 so that the temperatures thereof are raised to about 200° C. Since the first thermistor 30 of the first section is located in an atmosphere of dried air, it dissipates a predetermined amount of heat. On the other hand, the second thermistor 31 of the second section 29 varies an amount of heat dissipated therefrom in accordance with an amount of moisture content of the air flowing into the interior thereof. The first and second thermistors 30 and 31 are connected in a bridge configuration together with resistances 33 and 34 in a humidity sensing circuit 32 as shown in FIG. 7. A connection between the first and second thermistors 30 and 31 is connected to an input terminal 35*a* of an amplifier 35, whereas a connection between the resistances 33 and 34 is connected to an input terminal 35*b* of the amplifier 35. In the above-described arrangement, the amplifier 35 produces at its output terminal 35*c* a humidity signal with a voltage level corresponding to an absolute humidity of the air flowing into the interior of the second section 29.

The operation of the microwave oven will now be described with FIGS. 1, 2, and 8 to 12. The following description of the operation relates particularly to execution of a warming course wherein the food 2 is automatically heated. FIGS. 1 and 2 are flowcharts roughly showing the control contents of the warming course contained in the control program stored in the memory of the control circuit 25.

Figure 8:
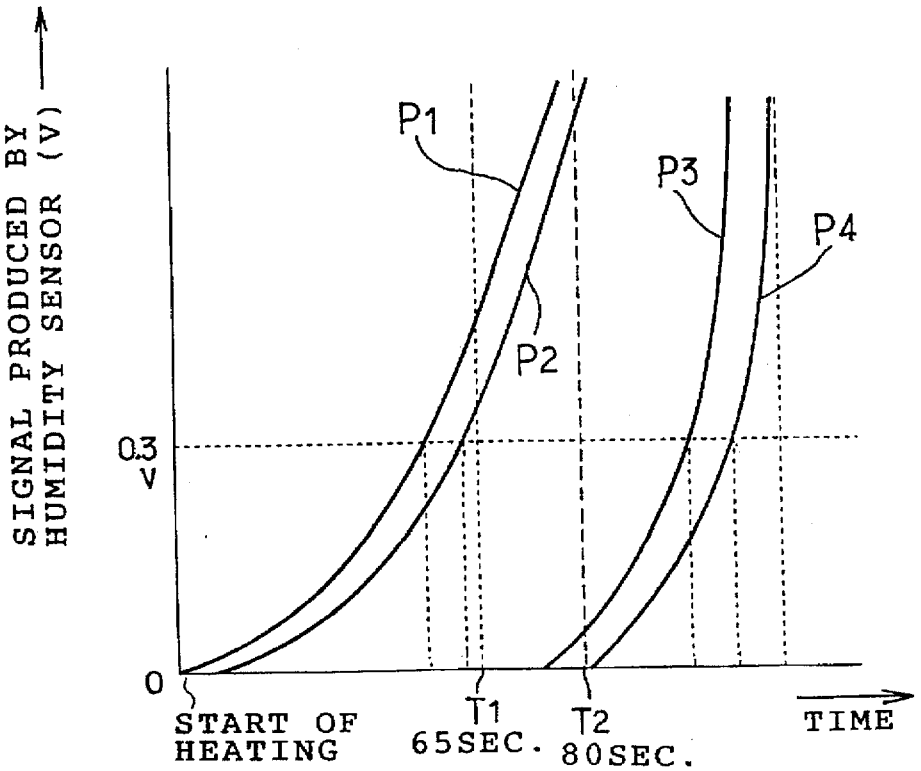
FIG. 8 is a graph of characteristic curves showing variations in the voltage levels of signals produced by the humidity sensor with lapse of time with respect to two types of foods in the case where each food is wrapped in a wrap film and is not wrapped.

Referring first to FIG. 8, the description of the operation starts with principles of automatic determination as to whether the food 2 is wrapped in a wrap film or not. FIG. 8 is a graph showing the variations in voltages of the signals produced by the humidity sensor 16 when time elapses from initiation of a heating operation for the food 2. Curve P1 in FIG. 8 designates a case where the food 2 is "miso soup" not wrapped in a wrap film. Curve P2 designates a case where the food 2 is "boiled rice" not wrapped in a wrap film. Curve P3 designates a case where the food 2 is "miso soup" wrapped in a wrap film. Curve P4 designates a case where the food 2 is "boiled rice" wrapped in a wrap film. As obvious from FIG. 8, the voltage level of the humidity signal produced by the humidity sensor 16 is raised later in the case where the "miso soup" or the "boiled rice" is wrapped in a wrap film than in the case where the "miso soup" or the "boiled rice" is not wrapped in a wrap film. Consequently, a time T is measured which starts at the initiation of the heating operation and which is required for the voltage level of the humidity signal to be raised to a predetermined wrap film discrimination value (0.3 V, for example). Then, whether the food 2 is wrapped in a wrap film or not can be determined on the basis of the measured time T.

In the above-described embodiment, the food 2 is determined, on the basis of the time T, to be in one of three conditions, that is, a first condition where the food 2 is not wrapped in a wrap film, a second condition where the food 2 is wrapped in a wrap film, and a third condition which belongs neither to the first or to the second condition. More specifically, the food 2 is determined to be in the first condition when the time T is at or below a first discrimination time T1 (65 seconds, for example). The food 2 is determined to be in the second condition when the time T exceeds a second discrimination time T2 (80 seconds, for example). The food 2 is further determined to be in the third condition when the time T exceeds the first discrimination time T1 and is at or below the second discrimination time T2.

The above-described first and second discrimination times T1 and T2 are each set to be shorter than an excessive heating preventing heating time $T_{max}$ which is provided for preventing the food 2 from being excessively heated. The excessive heating preventing heating time $T_{max}$ is a maximum heating time period for which the food 2 is heated such that the food 2 becomes eatable, but is not an optimum heating time period for the food 2. The excessive heating preventing heating time $T_{max}$ is set stepwise in accordance with the weight of the food 2. For example, the excessive heating preventing heating time $T_{max}$ is set in accordance with divisions of the weight G of the food 2 as follows: The time $T_{max}$ is set at 140 seconds when $0 \leqq G \leqq 400$ g. The time $T_{max}$ is set at 200 seconds when $400 < G \leqq 680$ g. The time $T_{max}$ is set at 300 seconds when $680 < G \leqq 940$ g. The time $T_{max}$ is set at 450 seconds when 940 g<G.

A total heating time for the above-mentioned heating operation or the warming course is calculated in the following manner in the embodiment. That is, a time period $T_\alpha$ is measured which is between initiation of a heating operation and the time the voltage level of the humidity signal produced by the humidity sensor 16 reaches a predetermined remaining time calculating value α (0.3 V, for example). The measured time $T_\alpha$ is multiplied by a predetermined remaining heating time calculating constant β so that a heating time from the end of time $T_\alpha$ on is obtained, which heating time serves as a remaining heating time. FIG. 9 schematically illustrates a manner of obtaining the remaining heating time when the wrap film discrimination value is set to be equal to the remaining time calculating value (0.3 V).

The above-mentioned remaining time calculating constant β is variable in accordance with the condition of the food 2. More specifically, in the embodiment, the constant β is set at 0.8 when the food 2 is in the first condition ($T \leqq 65$ seconds) where it is not wrapped in a wrap film. The constant β is set at 0.1 when the food 2 is in the second condition (80 seconds<T). When the food 2 is in the third condition which belongs neither to the first or to the second condition ($65 < T \leqq 80$ seconds), the constant β is obtained in terms of the equation, $\beta = (64 - 0.8T)/15$. FIG. 10 schematically illustrates the manner of setting the remaining time calculating constant β.

The execution of warming for the food 2 will now be described with reference to FIGS. 1 and 2. When a user selects the warming course and then operates the start switch **23*b* of the operation section 23 (step S1 in FIG. 1), the control circuit 25 executes a process in which the weight sensor 21 detects the weight of the food 2 (step S2). Subsequently, the excessive heating preventing heating time $T_{max}$ is set in accordance with the detected weight of the food 2** in the manner as described above (step S3).

An air cleaning operation is then executed for 15 seconds (step S4). In the air cleaning operation, the blowing fan unit 8 is energized to be driven so that outside air is supplied into the heating chamber 3. Upon lapse of 15 seconds, the control circuit 25 determines in the affirmative at step S4, advancing to step S5 where the magnetron 6 is oscillated so that the heating operation is initiated. With the initiation of the heating operation, a timer incorporated in the control circuit 25 starts its timing operation to measure the heating time T (step S6). The control circuit 25 then inputs the humidity signal from the humidity sensor 16, setting the voltage level of the input humidity signal for $V_{out}$ (step S7). In this regard, the humidity signal delivered from the amplifier 35 of the humidity sensing circuit 32 of the humidity sensor 16 is converted by an analog-to-digital (A/D) converter (not shown) to a digital signal, which digital signal the control circuit 25 takes in. The humidity signal produced by the humidity sensor 16 is input to the control circuit 25 while the drive voltage is not applied to the magnetron 6, for example, approximately in the middle of the while. More specifically, a commercial AC power supply voltage (100 V) is stepped up by a step-up transformer to a secondary AC voltage, which is further rectified by a voltage doubler rectifier circuit (not shown) into a half-wave rectified voltage. The obtained half-wave rectified voltage as shown in FIG. 11B is applied to the magnetron 6 when the same is energized. In FIG. 11A, the drive voltage is not applied to the magnetron 6 for a period $t_a$. The period $t_a$ appears per cycle of the commercial AC power supply. In the embodiment, the humidity signal produced by the humidity sensor 16 is input or sampled at a time approximately in the middle of the period $t_a$. FIG. 11A shows a time base signal in synchronism with the commercial AC power supply.

Subsequently, a minimum value $V_{min}$ is obtained from the humidity signals $V_{out}$ input from the humidity sensor 16. The control circuit 25 then determines whether or not the difference between the humidity signal $V_{out}$ and the minimum value $V_{min}$ has reached the wrap film discrimination value (0.3 V, for example). More specifically, the humidity signal $V_{out}$ is compared with a theretofore measured minimum value $V_{min}$ (step S8). When the humidity signal $V_{out}$ is smaller than the theretofore measured minimum value $V_{min}$, the control circuit 25 determines in the negative, setting the humidity signal $V_{out}$ as a new minimum value $V_{min}$ (step S9). Otherwise, the control circuit 25 determines in the affirmative. An initial value of the minimum value $V_{min}$ is previously set at 0 V. The control circuit 25 then determines whether the difference between the humidity signal $V_{out}$ and the minimum value $V_{min}$ is at or above 0.3 V (step S10).

Subsequently, the control circuit 25 determines in the affirmative at step S10 when the difference between the humidity signal $V_{out}$ and the minimum value $V_{min}$ is at or above 0.3 V before the heating time T measured from the initiation of the heating operation on reaches the excessive heating preventing heating time $T_{max}$. Based on the heating time T, the control circuit 25 determines whether the food 2 is wrapped in a wrap film or not or which of the above-described three conditions the food 2 is in. More specifically, the control circuit 25 first determines whether the time T is at or below the first discrimination time T1 (65 seconds, for example) at step S11 in FIG. 2. When the time T is at or below 65 seconds, the control circuit 25 determines in the affirmative, advancing to step S12 where the food 2 is determined to be in the first condition, that is, the food 2 is determined to be a non-wrapped food, for example, "boiled rice," "croquette," "miso soup," "happosai," "beef & potato stew" etc. The control , circuit 25 then sets the remaining heating time calculating constant β at 0.8, for example (step S13). "Happosai" is originally one of Chinese dishes. Pieces or slices of pork, Chinese cabbage, carrot, and so on are boiled in liquid starch.

The control circuit 25 determines in the negative at step S11 when the time T exceeds 65 seconds. The control circuit 25 then advances to step S12 where the same determines whether or not the time T exceeds 65 seconds and is at or below 80 seconds. When the time T exceeds 65 seconds and is at or below 80 seconds, the food 2 is determined to be in the third condition, that is, the food 2 is determined to be neither a wrapped nor a non-wrapped food, for example, "boiled rice," "croquette," "miso soup," "happosai," "beef & potato stew," etc. (step S141) The control circuit 25 then obtains the remaining heating time calculating constant β in terms of the equation, $\beta=(64-0.8T)/15$, setting the constant (step S15). Furthermore, the control circuit 25 determines in the negative at step S14 when the time T exceeds 80 seconds. In this case, the food 2 is determined to be in the second condition, that is, the food 2 is determined to be a wrapped food, for example, "boiled rice," "croquette," "miso soup," "happosai," "beef & potato stew," etc. (step S14) The control circuit 25 then sets the remaining heating time calculating constant β at 0.1, for example (step S17).

The remaining heating time $T_n$ is then calculated from the constant β set as described above and the heating time T in terms of the equation, $T_n=T\times\beta$ (step S18). The measured heating time T is added to the calculated remaining heating time $T_n$ so that a total heating time $T_t$ is obtained (step S19). The control circuit 25 then determines whether or not the obtained total heating time $T_t$ is at or below the excessive heating preventing heating time $T_{max}$ (step S20). When the total heating time $T_t$ is at or below the excessive heating preventing heating time $T_{max}$, the control circuit 25 determines in the affirmative at step S20, advancing to step S21 where the calculated remaining heating time $T_n$ is counted down so that the heating is executed for the time $T_n$. On the other hand, when the total heating time $T_t$ exceeds the excessive heating preventing heating time $T_{max}$, the control circuit 25 determines in the negative at step S20, a time ($T_{max}$–T) obtained by subtracting the heating time T from the excessive heating preventing heating time $T_{max}$ is counted down so that the heating operation is executed for the excessive heating preventing heating time $T_{max}$ (step S22).

The time which is counted down or an actual remaining heating time which is subtracted second by second is displayed on the display section 24 of the operation panel 22 (step S23). The control circuit 25 determines in the affirmative at step S24 when the remaining heating time expires. The control circuit 25 then advances to step S25 where the magnetron 6 is deenergized so that the heating operation is completed and where a buzzer (not shown) is activated so that completion of the heating operation is informed of.

The control circuit 25 determines in the affirmative at step S26 in FIG. 1 to thereby terminate the heating operation (step S25) when the heating time T has reached the excessive heating preventing heating time $T_{max}$ without the difference between the signal $V_{out}$ and the minimum value $V_{min}$ being at or above 0.3 V.

According to the above-described embodiment, the food 2 is automatically determined to be in one of the three conditions, that is, the first condition in which the food 2 is not wrapped in a wrap film, the second condition in which the food 2 is wrapped in a wrap film, and a third condition in which the food 2 belongs to neither the first nor the second condition. The remaining heating time $T_n$ is calculated on the basis of the results of the above-described determination. Consequently, a proper heating operation can be automatically executed whether the food 2 is wrapped in a wrap film or not or even when the food 2 is in the third condition. Accordingly, the user can use the microwave oven with the food being wrapped or not being wrapped in a wrap film, without relying upon an instruction manual for the microwave oven or cookbook. Thus, the usability of the microwave oven can be improved. Particularly in the above-described embodiment, the heating time can be precisely set even when the same type of food is wrapped in a wrap film in one case and is not wrapped in a wrap film in another case and even when a gas such as steam emanating from the food is insufficient such that it is difficult to determine the condition of the food. Furthermore, a heating output power may be set on the basis of the determined condition of the food.

The excessive heating preventing heating time $T_{max}$ is set in the foregoing embodiment. Even if the wrap film discrimination means should fail to determine about the presence or absence of a wrap film, the heating operation would be automatically terminated upon lapse of the excessive heating preventing heating time. More specifically, the heating operation is automatically terminated upon lapse of the excessive heating preventing heating time $T_{max}$ when the measured time T has reached the excessive heating preventing heating time $T_{max}$ without the difference between the signal $V_{out}$ and the minimum value $V_{min}$ being at or above 0.3 V. Consequently, the food 2 can be prevented from being excessively heated. Furthermore, since the excessive heating preventing heating time $T_{max}$ is set stepwise in accordance with the divisions of the weight of the food 2, the food can be further prevented from being excessively heated irrespective of the differences in the weight of the food or the differences in the manner of wrapping the food in a wrap film.

In the foregoing embodiment, the food 2 is determined to be in the first or non-wrapped condition when the measured heating time T is at or below the first discrimination time T1 (65 seconds, for example). The food 2 is determined to be in the second or wrapped condition when the time T is above the second discrimination time $T_2$ (80 seconds, for example). The food 2 is determined to be in the third condition belonging neither to the first nor to the second condition when the time T is above the first discrimination time T1 and at or below the second discrimination time T2. Consequently, the food 2 can be reliably classified into one of the three conditions. Thus, determination can be reliably made about the presence or absence of a wrap film, and the food 2 is classified into the third condition belonging neither to the first nor to the second condition when it is difficult to determine whether the food 2 is wrapped in a wrap film or not. Furthermore, the excessive heating preventing heating time $T_{max}$ is set to be longer than each of the first and second discrimination times T1 and T2. Consequently, the food 2 can be reliably prevented from being excessively heated even if the condition of the food 2 could not be determined due to the differences in the type of the food or the differences in the manner of wrapping the food in a wrap film.

In calculation of the remaining heating time, the time T is measured for which the difference between the humidity signal $V_{out}$ and the minimum value $V_{min}$ is increased to or above 0.3 V. The measured time T is multiplied by the constant β so that the remaining heating time $T_n$ is obtained. Consequently, the remaining heating time $T_n$ can be precisely calculated. Furthermore, since the wrap film discrimination value is set to be equal to the remaining time calculating value (0.3 V), the control arrangement can be simplified.

The remaining heating time calculating constant β is varied in accordance with the results of determination about the condition of the food. Consequently, the remaining heating time $T_n$ can be further precisely calculated. Furthermore, the constants β1, β2 and β3 corresponding to the first to third conditions of the food respectively are set to effect the relation, $\beta2<\beta3<\beta1$. Consequently, since the difference among the constants β1, β2 and β3 can be rendered larger depending upon the presence or absence of a wrap film, the remaining heating time $T_n$ can be further precisely calculated in accordance with the differences in the manner of wrapping the food in a wrap film.

The remaining heating time is displayed on the display section 24 of the operation panel 22, counted down second by second, for example. The user can confirm the remaining heating time at nay time during execution of the heating operation. Consequently, the usability of the microwave oven can be improved.

Figure 12:
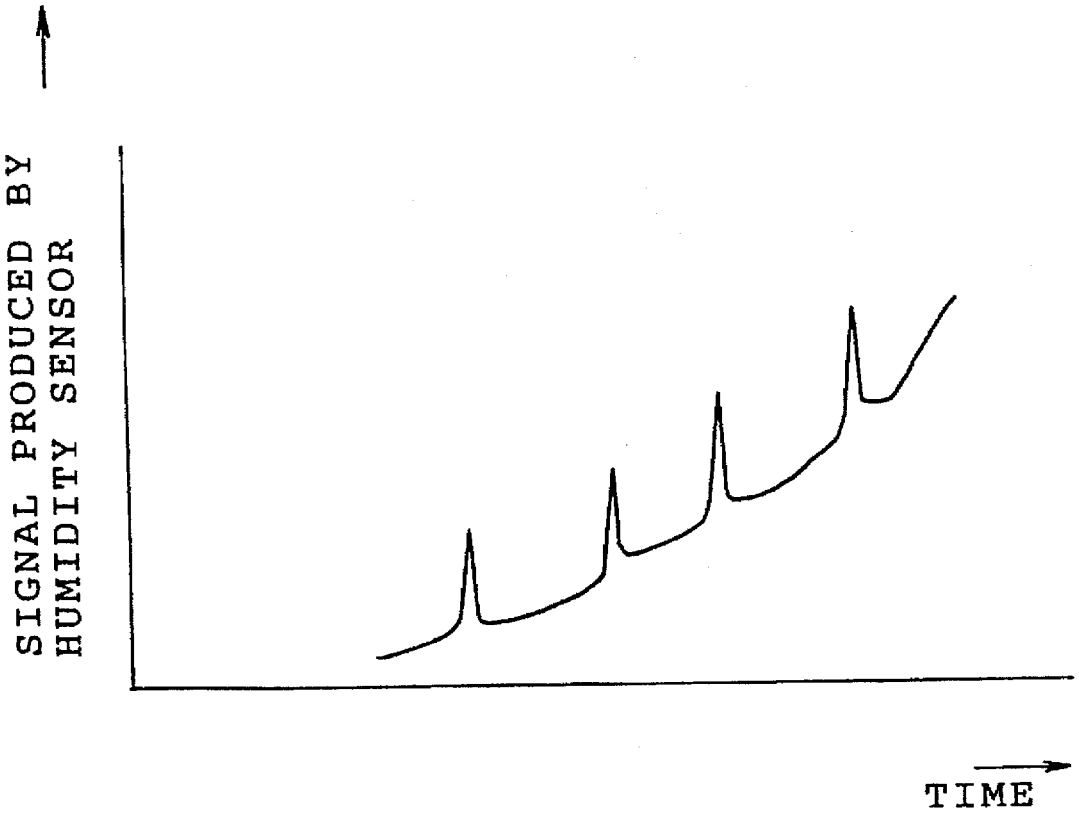
FIG. 12 is a graph showing a signal from the humidity sensor with noise superimposed.

The inventors found that an electrical noise as shown in FIG. 12 was superimposed on the humidity signal produced by the humidity sensor 16 and that the noise was in synchronism with the voltage waveform of the drive voltage applied to the magnetron 6 or the half-wave rectified voltage as shown in FIG. 11B. The noise is considered to result from the microwaves oscillated from the magnetron 6. The noise raises the voltage level of the humidity signal. Accordingly, in the case where the control circuit 25 inputs the humidity signal when the noise is superimposed thereon, an error detection would take place. Consequently, the heating time would be shortened, which results in insufficiency in the heating. In the foregoing embodiment, however, the humidity signal produced by the humidity sensor 16 is input or sampled at a time approximately in the middle of the period $t_a$ during which the drive voltage is not applied to the magnetron 6, as shown in FIG. 11B. Accordingly, the noise resulting from the oscillation of the magnetron 6 can be prevented from being superimposed on the humidity signal. Consequently, since the insufficiency in the heating can be prevented, a further precise heating control can be provided.

In the foregoing embodiment, the remaining heating time calculating constant β is set at 0.1 when the food 2 has been determined to be in the second condition. The constant β may be set at 0, and the heating operation may be terminated immediately when the food 2 is determined to be in the second condition, instead. In this case, too, a desired heating operation can be executed when the food is determined to be in either the first or third condition as well as in the second condition.

Figure 13:
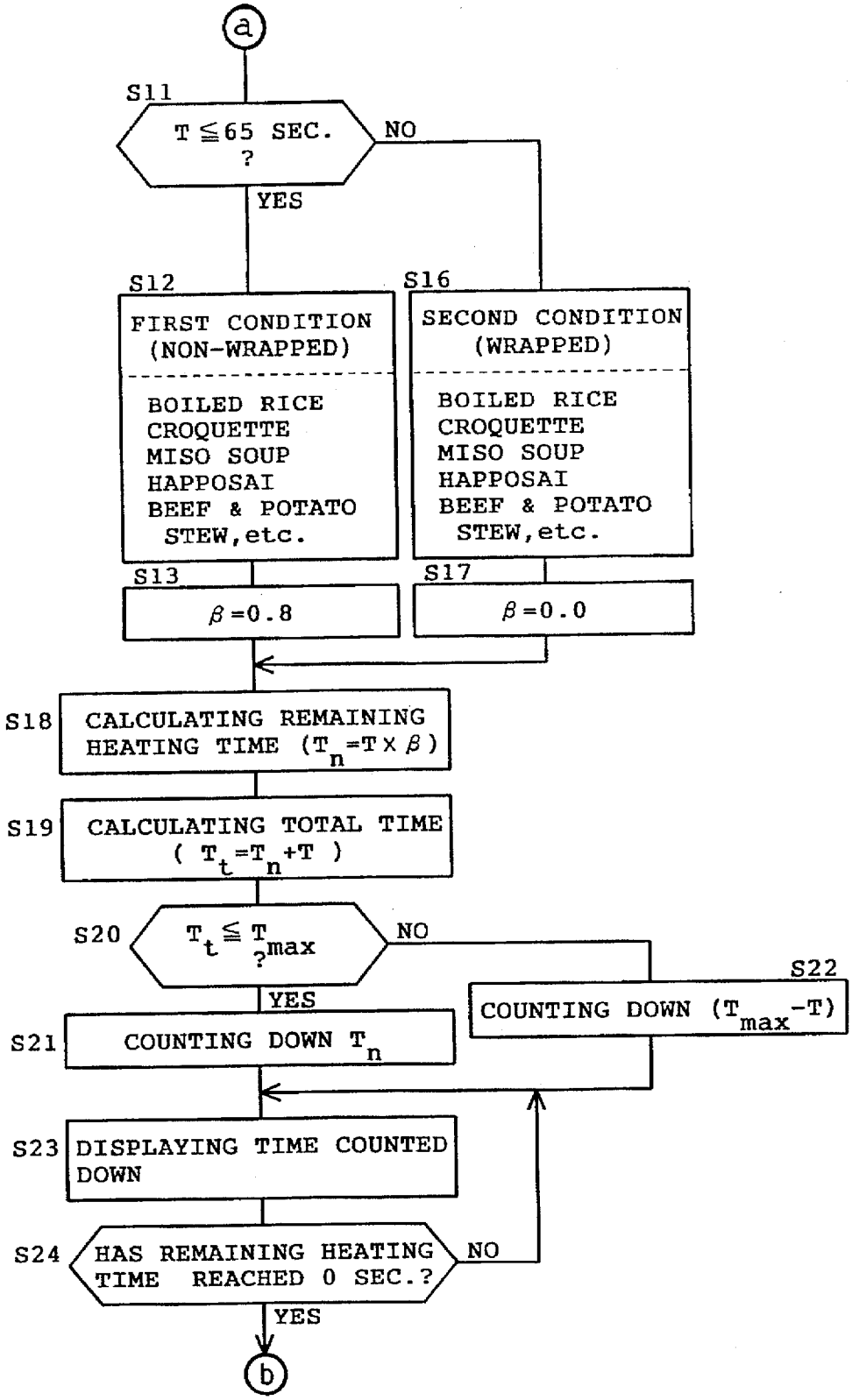
FIG. 13 is a flowchart similar to FIG. 2, showing the control sequence of the control circuit incorporated in a microwave oven of a second embodiment in accordance with the present invention.

FIG. 13 illustrates a second embodiment of the present invention. The difference between the first and second embodiments will be described. In the second embodiment, the control circuit 25 is adapted to discriminate with respect to the food 2 between the first condition in which the food is not wrapped in a wrap film and the second condition in which the food is wrapped in a wrap film. More specifically, steps S1 to S11 are the same as those in FIGS. 1 and 2. The food 2 is determined to be in the first condition when the measured time T is at or below the discrimination time (65 seconds) at step S11. The food 2 is determined to be in the second condition when the measured time T exceeds the discrimination time. The remaining heating time calculating constant β is set at 0.0 when the food 2 is determined to be in the second condition (step S17).

The other arrangement is the same as that in the first embodiment. Approximately the same effect can be achieved in the second embodiment as in the first embodiment. Although the food is determined to be either in the first or in the second condition by the control circuit 25 and the remaining heating time is calculated in accordance with the results of discrimination in the second embodiment, a sufficiently proper remaining heating time can be obtained, and the control arrangement can be simplified.

Figure 14:
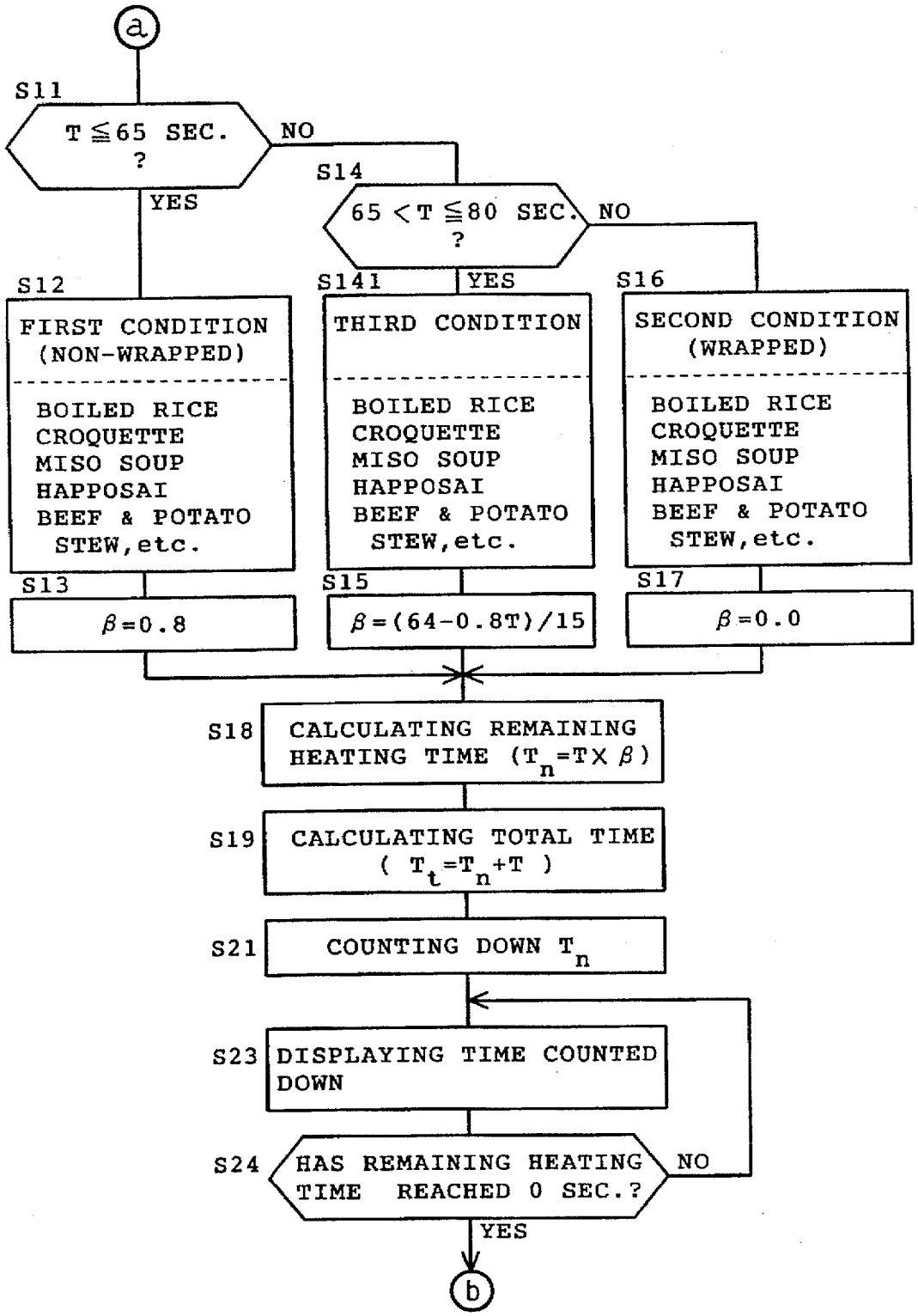
FIG. 14 is a flowchart similar to FIG. 2, showing the control sequence of the control circuit incorporated in a microwave oven of a third embodiment in accordance with the present invention.

FIG. 14 illustrates a third embodiment of the present invention. The difference between the first and third embodiment will be described. In the third embodiment, the control circuit 25 is adapted to discriminate with respect to the food 2 among the first condition in which the food is not wrapped in a wrap film, the second condition in which the food is wrapped in a wrap film, and the third condition belonging neither to the first nor to the second condition. The remaining heating time $T_n$ is calculated on the basis of the results of discrimination. The measured time T is added to the calculated remaining heating time $T_n$ so that the total heating time $T_t$ is obtained. Thereafter, the heating is executed for the remaining heating time $T_n$ of the total heating time $T_t$. The total heating time $T_t$ is given priority even when the same exceeds the excessive heating preventing heating time $T_{max}$.

Steps S20 and S22 in FIG. 2 are eliminated in the flowchart of FIG. 14. The remaining heating time calculating constant β is set at 0.0, for example when the food 2 is determined to be in the second condition. The heating is terminated immediately when the food is determined to be in the second condition (step S17). The other arrangement is the same as that in the first embodiment. Accordingly, approximately the same effect can be achieved in the third embodiment as in the first embodiment. Particularly in the third embodiment, the heating operation is executed for the obtained remaining heating time $T_n$. Thus, since the remaining heating time $T_n$ is given priority, the food 2 can be sufficiently heated even in the case where the heating tends to be insufficient when the food is heated for the excessive heating preventing heating time $T_{max}$. Consequently, insufficiency in the heating can be reliably prevented.

Although the remaining heating time calculating constant β is set at 0.0 in the third embodiment when the food 2 is determined to be in the second condition, the constant may be set at 0.1 or the value approximate to 0.0, instead. In this case, too, the same effect can be achieved.

Figure 15:
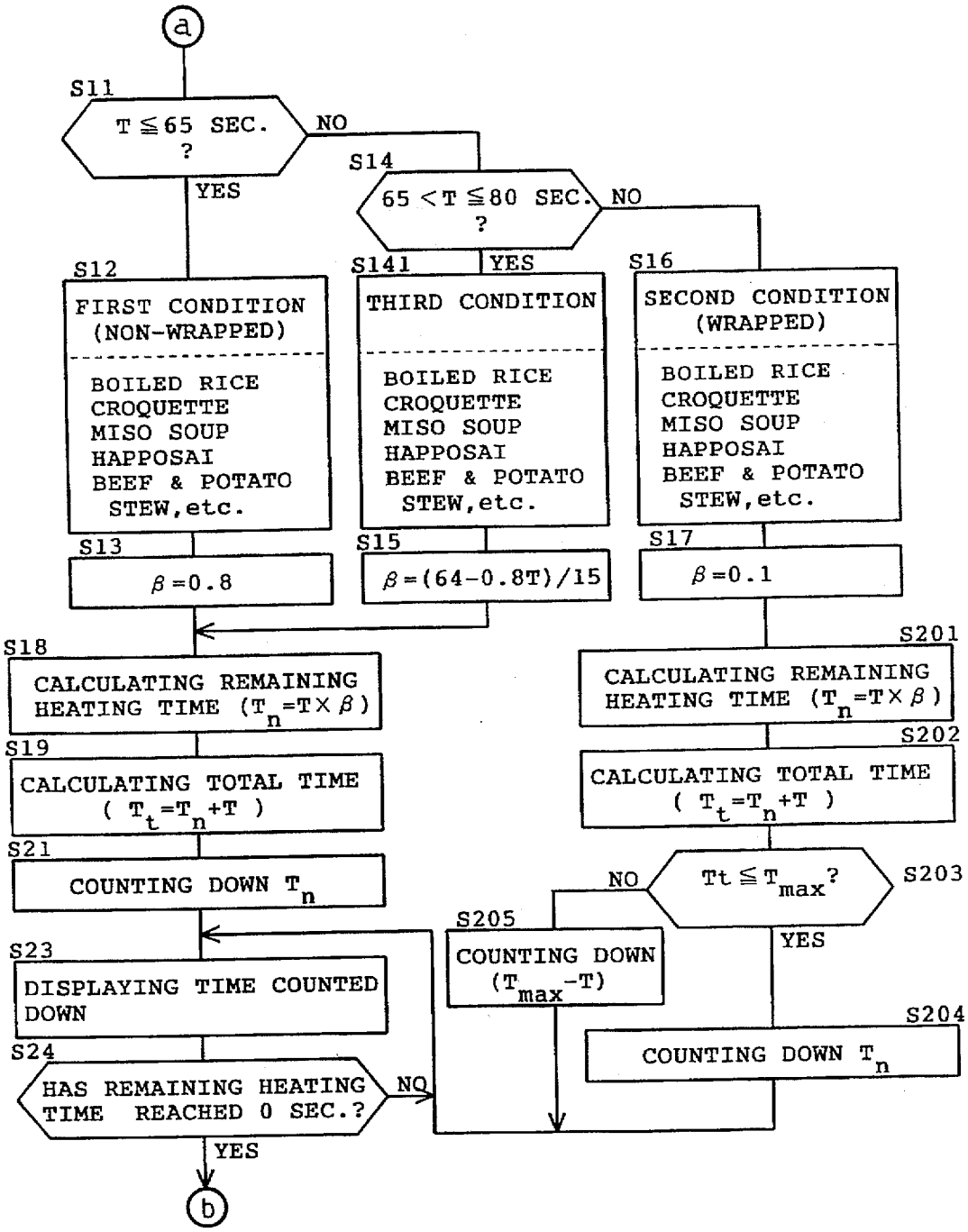
FIG. 15 is a flowchart similar to FIG. 2, showing the control sequence of the control circuit incorporated in a microwave oven of a fourth embodiment in accordance with the present invention.

FIG. 15 illustrates a fourth embodiment of the present invention. The difference between the third and fourth embodiments will be described. In the fourth embodiment, the control circuit 25 is adapted to discriminate with respect to the food 2 among the first condition in which the food is not wrapped in a wrap film, the second condition in which the food is wrapped in a wrap film, and the third condition belonging neither to the first nor to the second condition. The remaining heating time $T_n$ is calculated on the basis of the result of discrimination. The measured time T is added to the calculated remaining heating time $T_n$ so that the total heating time $T_t$ is obtained. Thereafter, the heating operation is executed for the remaining heating time $T_n$ of the total heating time $T_t$ when the food 2 has been determined to be in each of the first and third conditions. When the food 2 has been determined to be in the second condition, the obtained total heating time $T_t$ is compared with the excessive heating preventing heating time $T_{max}$ such that the heating operation is executed for the time $T_{max}$ at the longest.

The control is executed in the same manner as in the third embodiment when the food has been determined to be in each of the first and third conditions, as is shown in FIG. 15. On the other hand, the remaining heating time calculating constant β is set at 0.1 at step S17 when the food 2 has been determined to be in the second condition. Thereafter, the remaining heating time $T_n$ is calculated in terms of the equation, $T_n = T \times \beta$, on the basis of the set constant β and the measured time period T (step S201). The measured time T is added to the calculated remaining heating time $T_n$ so that the total heating time $T_t$ is obtained (step S202). Subsequently, the control circuit 25 determines whether or not the obtained total heating time $T_t$ is at or below the excessive heating preventing heating time $T_{max}$ (step S203).

The control circuit 25 determines in the affirmative at step S203 when the total heating time $T_t$ is at or below the excessive heating preventing heating time $T_{max}$. In this case, the obtained remaining heating time $T_n$ is counted down so that the heating is executed for the time $T_n$ (step S204). On the other hand, the control circuit 25 determines in the negative at step S203 when the total heating time $T_t$ exceeds the excessive heating preventing heating time $T_{max}$. In this case, the measured time period T is subtracted from the excessive heating preventing heating time $T_{max}$, and the obtained time is counted down so that the heating is executed for the time $T_{max}$ at the longest (step S205). The other arrangement is the same as that in the third embodiment. Accordingly, approximately the same effect can be achieved in the fourth embodiment as in the third embodiment. Particularly in the fourth embodiment, the excessive heating preventing heating time $T_{max}$ is given priority in the case where the obtained remaining heating time $T_n$ is longer than the excessive heating preventing heating time $T_{max}$ when the food 2 has been determined to be in the second condition. Consequently, the food 2 can be reliably prevented from being excessively heated even though the food determined to be in the second condition tends to be excessively heated.

Figure 16:
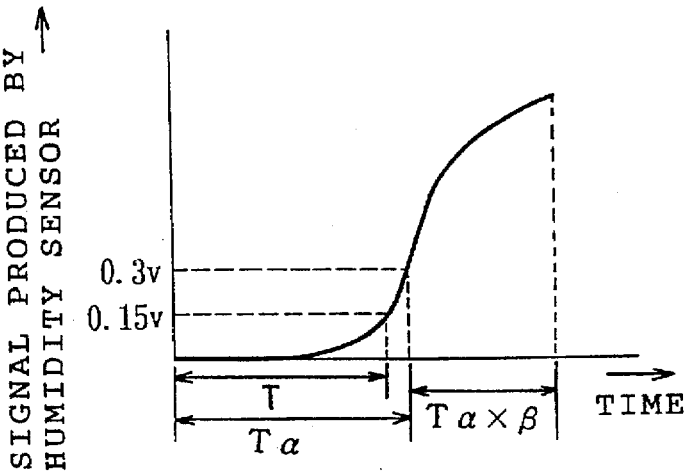
FIG. 16 is a graph similar to FIG. 9, showing the characteristic curve in a microwave oven of a fifth embodiment in accordance with the present invention.

Although the wrap film discrimination value and the remaining heating time calculating set value α are set to be equal to each other in each of the foregoing embodiments, these values may be set at different values from each other as in a fifth embodiment shown in FIG. 16. In the fifth embodiment, the wrap film discrimination value and the set value α are set at 0.15 V and 0.3 V respectively, for example, as shown in FIG. 16. At a time the humidity signal input from the humidity sensor 16 reaches the wrap film discrimination value of 0.15 V, the food 2 is determined to be in any one of the three conditions with respect to a wrap film on the basis of a time period between the initiation of the heating operation and that time. The wrap film discrimination time employed for the discrimination is set to correspond to the wrap film discrimination value (0.15 V).

Subsequently, at a time the humidity signal input from the humidity sensor 16 reaches 0.3 V, the remaining heating time is calculated on the basis of a time period from the initiation of the heating operation to that time. The remaining heating time calculating constant β employed for the calculation of the remaining heating time is set to correspond to the remaining heating time calculating set value of 0.3 V and is the same as that in the first embodiment. The other arrangement is the same as that in the first embodiment. Accordingly, the same effect can be achieved in the fifth embodiment as in the first embodiment.

Figure 17:
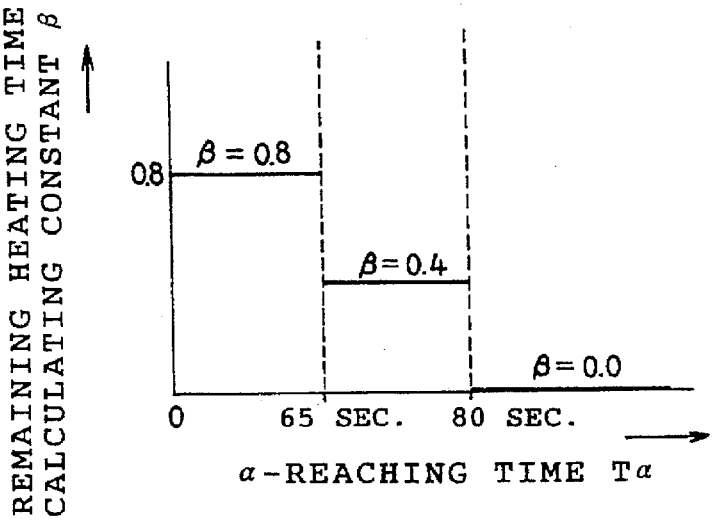
FIG. 17 is a graph similar to FIG. 10, showing the relation between a remaining heating time calculating constant β and the results of determination about the presence or absence of a wrap film in a microwave oven of a sixth embodiment in accordance with the present invention.
Figure 18:
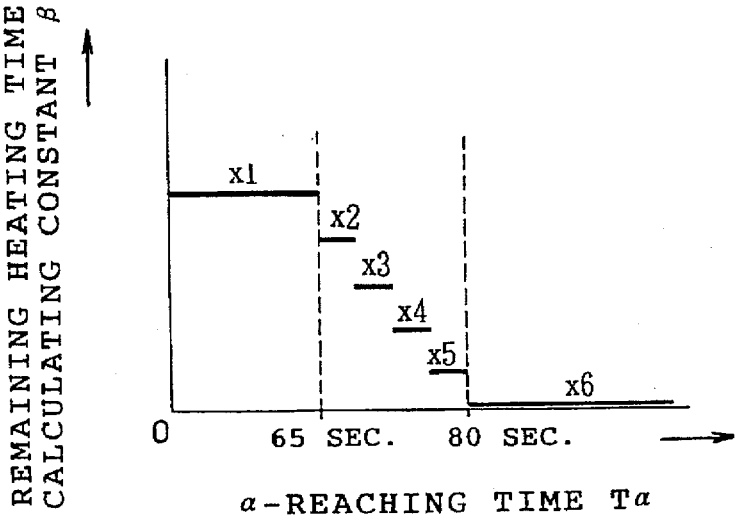
FIG. 18 is a graph similar to FIG. 10, showing the relation between a remaining heating time calculating constant β and the results of determination about the presence or absence of a wrap film in a microwave oven of a seventh embodiment in accordance with the present invention.

In each of the foregoing embodiments, the remaining heating time calculating constant β is obtained by the equation (linear function) with, as a variable, the time $T_\alpha$ elapsing until the signal produced by the humidity sensor 16 reaches the remaining heating time calculating set value of 0.3 V. However, the remaining heating time calculating constant β may be set at a fixed value, for example, at 0.4 when the food 2 is determined to be in the third condition, as in a sixth embodiment of the invention shown in FIG. 17. Furthermore, the constant β may be set at x1 (0.8, for example) when the food 2 is determined to be in the first condition, and the constant β may be set at x6 (0.0 or 0.1, for example) when the food 2 is determined to be in the second condition, as in a seventh embodiment shown in FIG. 18. In this case, four fixed values X2, X3, x4 and x5 are provided for the constant β when the food 2 is determined to be in the third condition. The set value of the constant β is preferably rendered smaller (for example, x1<x2<x3<x4<x5<x6) as the time $T_\alpha$ becomes long. Consequently, the remaining heating time can be calculated further accurately.

Figure 19:
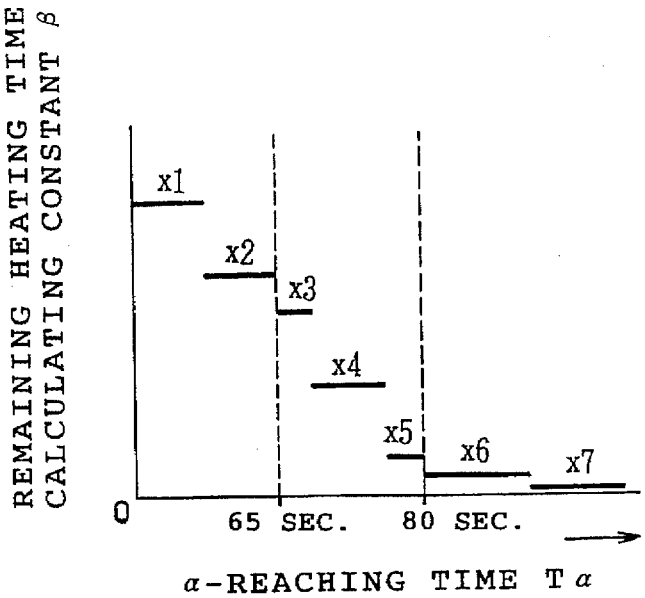
FIG. 19 is a graph similar to FIG. 10, showing the relation between a remaining heating time calculating constant β and the results of determination about the presence or absence of a wrap film in a microwave oven of an eighth embodiment in accordance with the present invention.

FIG. 19 shows an eighth embodiment of the invention. In the eighth embodiment, two fixed values x1 and x2 (x1<x2, for example) are provided for the remaining heating time calculating constant β when the food 2 is in the first condition. Three fixed values x3, x4 and x5 (x3<x4<x5, for example) are provided for the constant β when the food 2 is determined to be in the third condition. Two fixed values x6 and x7 (x6<x7, for example) are provided for the constant β when the food 2 is determined to be in the second condition. In this embodiment, too, the set value of the constant β is preferably rendered smaller as the time $T_\alpha$ becomes long. Consequently, the remaining heating time can be calculated further accurately.

Figure 20:
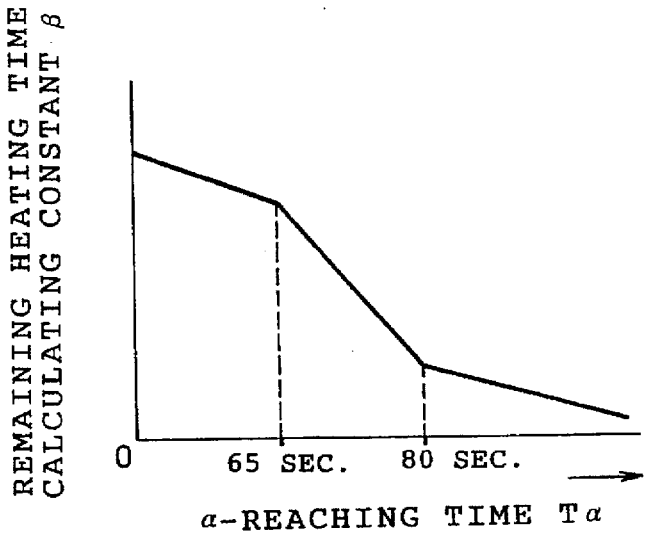
FIG. 20 is a graph similar to FIG. 10, showing the relation between a remaining heating time calculating constant β and the results of determination about the presence or absence of a wrap film in a microwave oven of a ninth embodiment in accordance with the present invention.

FIG. 20 illustrates a ninth embodiment of the invention. The constant β in each of the three conditions of the food 2 is obtained by the equation (linear function) with, as a variable, the time $T_\alpha$ elapsing until the signal produced by the humidity sensor 16 reaches the remaining heating time calculating set value of 0.3 V. In this case, three equations are provided to correspond to the three conditions of the food 2 with respect to a wrap film respectively. Furthermore, the constant β is preferably rendered smaller as the time $T_\alpha$ becomes long.

Figure 21:
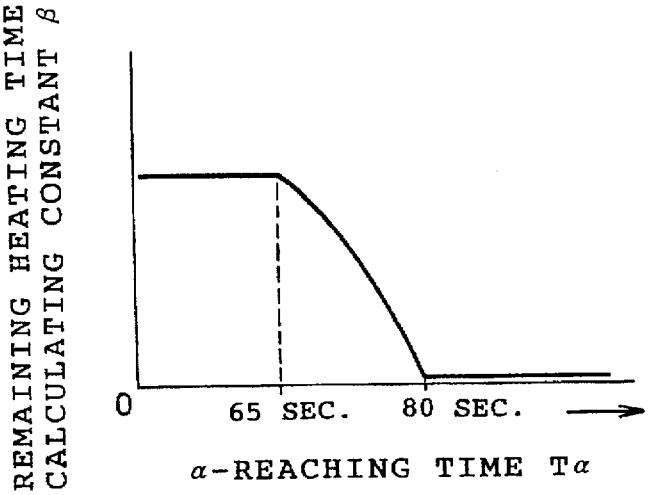
FIG. 21 is a graph similar to FIG. 10, showing the relation between a remaining heating time calculating constant β and the results of determination about the presence or absence of a wrap film in a microwave oven of a tenth embodiment in accordance with the present invention.

FIG. 21 illustrates a tenth embodiment of the invention. Two fixed values (0.8 and 0.0, for example) are provided for the constant β in the first and second conditions of the food 2 respectively. The constant β in the third condition of the food 2 is obtained by an equation (curvilinear function as shown in FIG. 21) with, as a variable, the time $T_\alpha$ elapsing until the signal produced by the humidity sensor 16 reaches the remaining heating time calculating set value.

The relation between the weight of the food 2 and the remaining heating time calculating constant β has not been described in each of the foregoing embodiments. The constant β is preferably set in accordance with the weight of the food 2. More specifically, the constant β is preferably varied in accordance with divisions of the weight of the food 2 and in accordance with the result of discrimination regarding the food 2, as is shown in the following TABLE 1:

TABLE 1

| Weight | First condition | | Third condition β (linear | Second condition (boiled rice) | | Maximum heating |
|---|---|---|---|---|---|---|
| (g) | β | T1 | function) | T2 | β | time ($T_{max}$) |
| 0–400 | 0.8 | 65" | (84–0.8 T)/15 | 80" | 0 | 140" |
| 401–680 | 2.0 | 80" | (220–2.0 T)/30 | 110" | 0 | 200" |
| 681–940 | 2.5 | 90" | (375–2.5 T)/60 | 150" | 0 | 300" |
| 941– | 2.5 | 130" | (475–2.5 T)/60 | 190" | 0 | 450" |

An accurate determination can be made about the presence or absence of a wrap film irrespective of an amount of food 2, and the remaining heating time can be accurately calculated when the remaining heating time calculating constant β is set as shown in TABLE 1. Furthermore, since the first and second wrap film discrimination times T1 and T2 are also varied in accordance with the weight of the food 2, a further accurate determination can be provided.

The excessive heating preventing heating time $T_{max}$ is set stepwise in accordance with the weight of the food 2, for example, in four stages in the foregoing embodiments. The time $T_{max}$ may be obtained by a time calculating equation ($T_{max}$=0.25x+78) with, as a variable, the weight of the food 2, instead. In this case, too, the food 2 can be prevented from being excessively heated.

Figure 22:
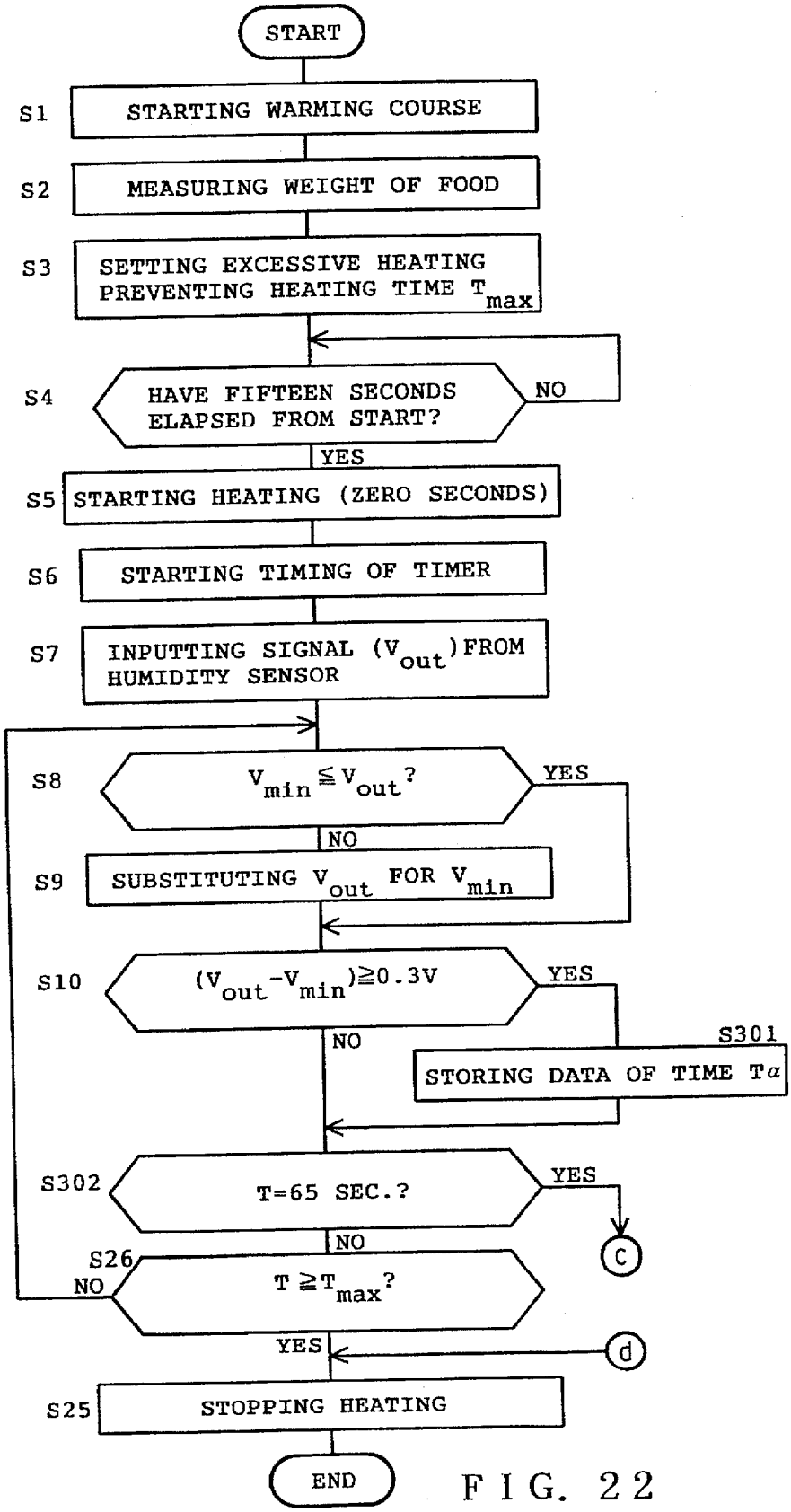
FIG. 22 is a flowchart similar to FIG. 1, showing the control sequence of the control circuit incorporated in a microwave oven of an eleventh embodiment in accordance with the present invention.
Figure 23:
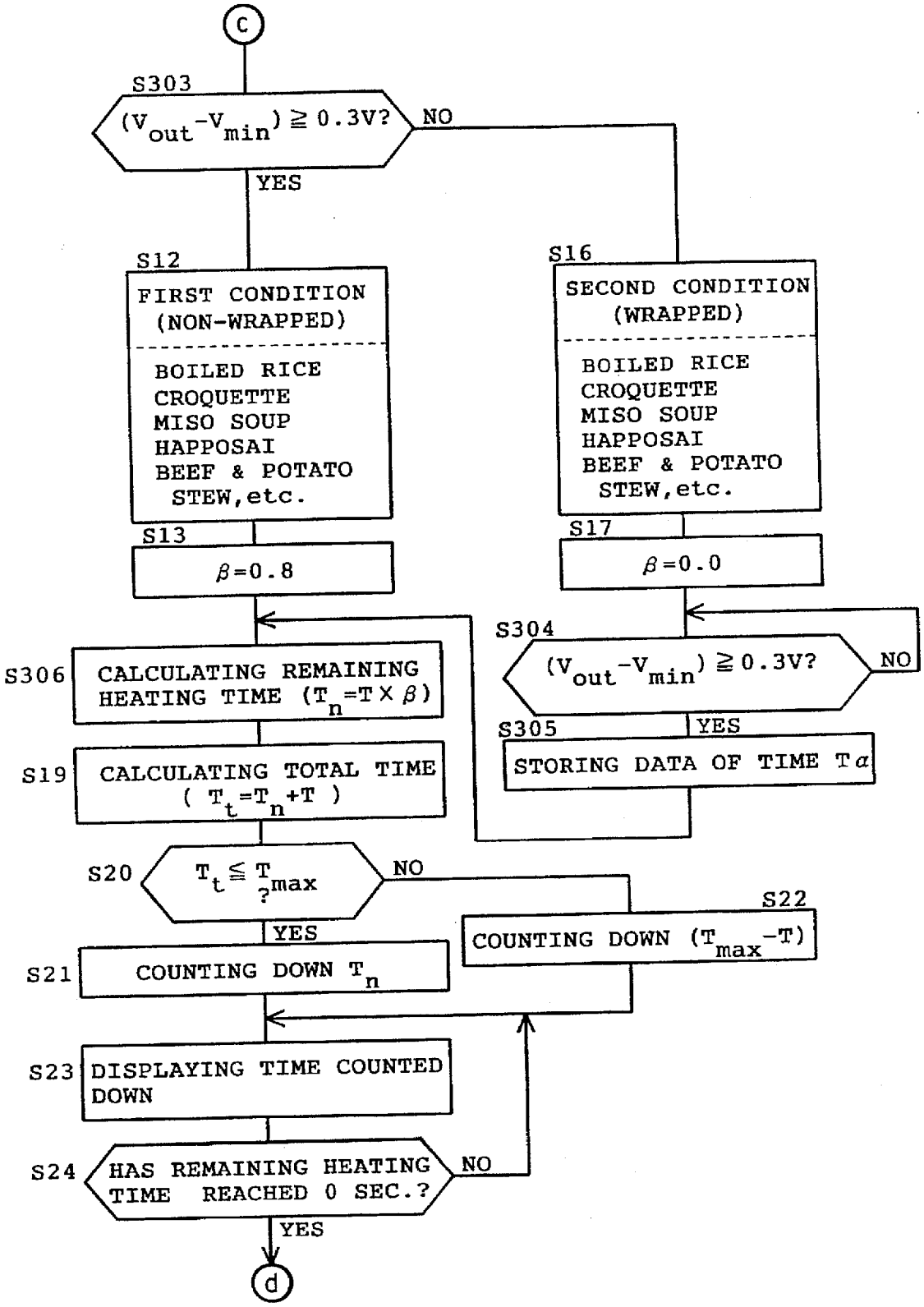
FIG. 23 is a flowchart similar to FIG. 2 in the eleventh embodiment.

FIGS. 22 and 23 illustrates an eleventh embodiment of the invention. The difference between the first and eleventh embodiments will be described. In the eleventh embodiment, the humidity signal produced by the humidity sensor 16 is input at a time a set time (65 seconds, for example) starting with the initiation of the heating operation elapses. The food 2 is determined to be either in the first or in the second condition depending upon whether the input humidity signal is at or above the wrap film discrimination value (0.3 V, for example). More specifically, steps S1 to S10 in FIG. 22 are the same as those in FIG. 1. At step S10, the control circuit 25 determines in the affirmative when the humidity signal or the difference between the signal $V_{out}$ and the minimum value $V_{min}$ is at or above 0.3 V. The control circuit 25 then stores data of the theretofore measured time $T_\alpha$ (step S301). Subsequently to step S301 and when the control circuit 25 determines in the negative at step S10, the control circuit 25 advances to step S302 to determine whether or not 65 seconds have elapsed from the initiation of the heating operation.

Subsequently, upon lapse of 65 seconds from the start of the heating, the control circuit 25 determines in the affirmative at step S302, advancing to step S303 to determine whether or not the difference between the signal $V_{out}$ and the minimum value $V_{min}$ is at or above 0.3 V. When the difference is at or above 0.3 V, the control circuit 25 determines in the affirmative at step S303, advancing to step S12 where the food 2 is determined to be in the first condition. Then, the remaining heating time calculating constant β is set at 0.8, for example (step S13).

On the other hand, the control circuit 25 determines in the negative at step S303 when the difference is below 0.3 V. The control circuit 25 then determines that the food 2 is in the second condition (step S16). The control circuit 25 then sets the remaining heating time calculating constant β at 0.0, for example (step S17), then standing by until the difference is increased to or above 0.3 V (step S304). Thereafter, the control circuit 25 determines in the affirmative at step S304 when the difference has been increased to or above 0.3 V, then storing data of a theretofore measured time $T_\alpha$ (step S305).

Based on the constant β set as described above and the stored time Tα, the control circuit 25 obtains the remaining heating time $T_n$ by the equation, $T_n=T_\alpha\times\beta$ (step S306). The subsequent control is the same as that in the first embodiment. The times T in steps S19 and S22 are those elapsed theretofore from the initiation of the heating operation respectively, and the time T is equal to the stored time $T_\alpha$ when the food 2 is determined to be in the second condition. The other arrangement in the eleventh embodiment is the same as that in the first embodiment. Accordingly, the same effect can be achieved in the eleventh embodiment as in the first embodiment.

Figure 24:
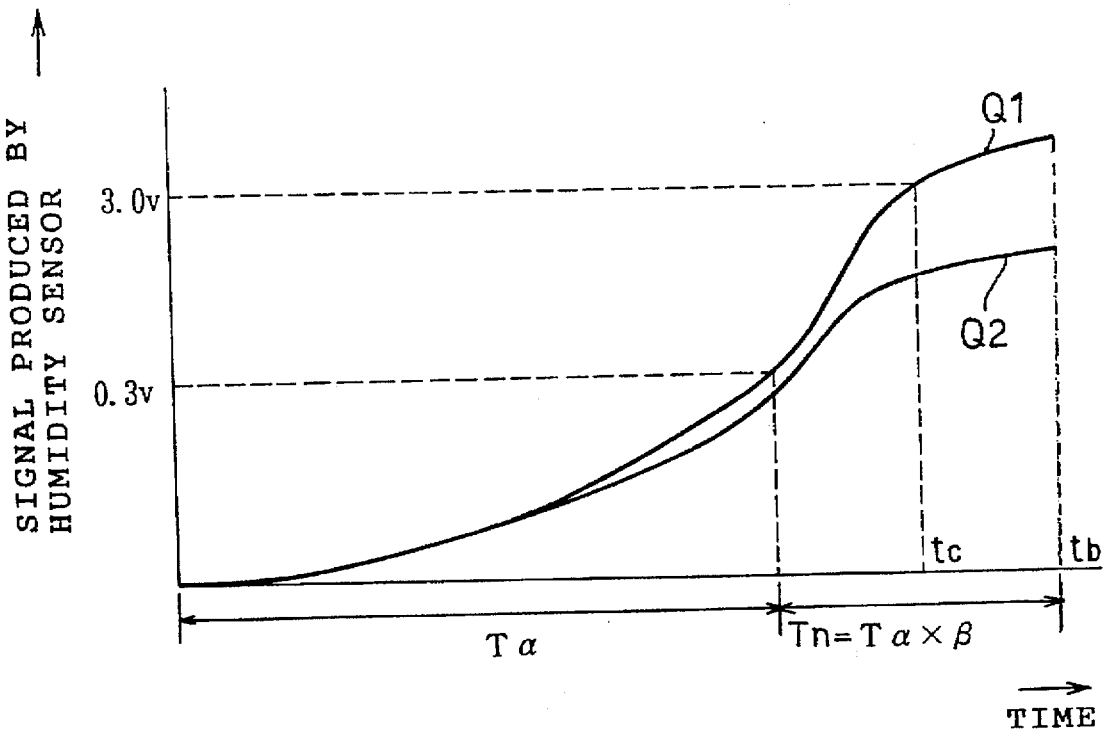
FIG. 24 is a graph similar to FIG. 9, showing the characteristic curve in a microwave oven of a twelfth embodiment in accordance with the present invention.
Figure 25:
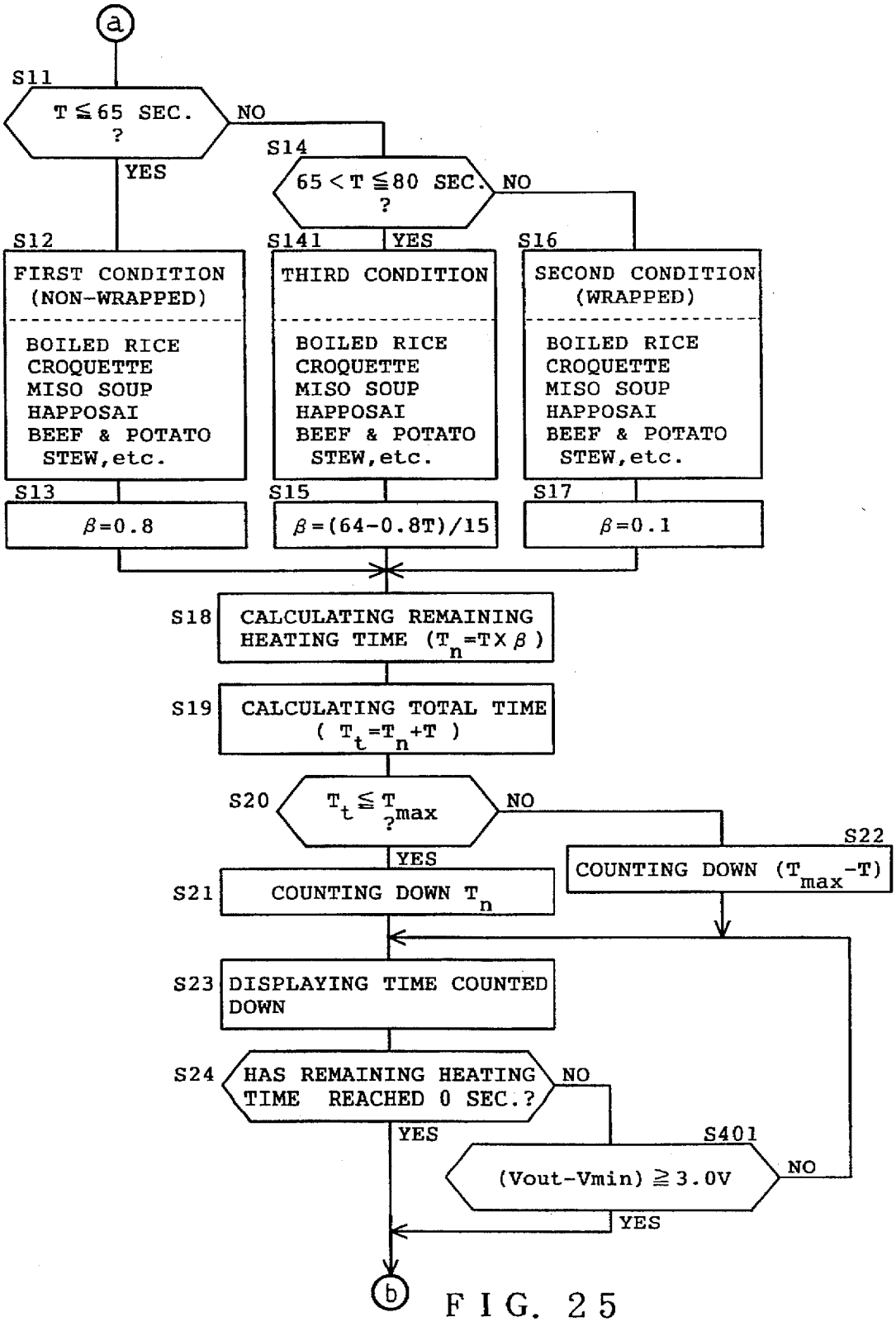
FIG. 25 is a flowchart similar to FIG. 2 in the twelfth embodiment.

FIGS. 24 and 25 illustrate a twelfth embodiment of the invention. The difference between the first and twelfth embodiments will be described. In the twelfth embodiment, the heating is automatically terminated when the humidity signal produced by the humidity sensor 16 or the difference between the signal $V_{out}$ and the minimum value $V_{min}$ has reached a predetermined maximum output power limit value (0.3 V, for example).

More specifically, step S1 to S24 in FIG. 25 are the same as those in FIGS. 1 and 2. The control circuit 25 determines in the negative at step S24 when the remaining heating time is not zero. The control circuit 25 then advances to step S401 to determine whether the difference between the input humidity signal $V_{out}$ and the minimum value $V_{min}$ is at or above 0.3 V. The control circuit 25 determines in the affirmative at step S401 when the difference is at or above 0.3 V, advancing to step S25 (FIG. 1) to terminate the heating. On the other hand, the control circuit 25 determines in the negative at step S401 when the difference is below 0.3 V, continuing countdown of the remaining heating time (step S23). The other arrangement in the twelfth embodiment is the same as that in the first embodiment. Accordingly, the same effect can be achieved in the twelfth embodiment as in the first embodiment.

Particularly in the twelfth embodiment, the heating operation is terminated when the difference between the signal $V_{out}$ and the minimum value $V_{min}$ has reached 3.0 V before expiration of the calculated remaining heating time. This arrangement will be described in detail. Suppose now that one menu key (not shown) is provided for selecting a warming course wherein "boiled rice" and "happosai" are heated individually. In the warming of "boiled rice" the humidity signal produced by the humidity sensor 16 is varied as shown by curve Q1 in FIG. 24. On the other hand, the signal is varied as shown by curve Q2 in the warming of "happosai". The heating operation is terminated at time $t_b$ when the remaining heating time $T_n$ is calculated with a remaining heating time calculating constant β suitable for the "happosai" with respect to the "boiled" rice. In the case of "boiled rice" however it is desirable that the heating operation should be terminated at time $t_c$ at which the difference between the signal $V_{out}$ and the minimum value $V_{min}$ reaches 3.0 V. If the heating operation should be continued to time $t_b$, the "boiled rice" would be excessively heated. In the twelfth embodiment, however, the heating operation is terminated when the difference between the signal $V_{out}$ and the minimum value $V_{min}$ has reached 3.0 V before expiration of the calculated remaining heating time. Consequently, the excessive heating as described above can be prevented.

Although the maximum output power limit value is set at 0.3 V in the twelfth embodiment, it may be varied depending upon whether a wrap film is present or not. More specifically, the maximum output power limit value may be set, for example, at 2.5 V when the food 2 is determined to be in the second condition. The limit value may be set, for example, at 3.0 V when the food 2 is determined to be in the third condition. The limit value may be set, for example, at 3.5 V when the food 2 is determined to be in the first condition. This arrangement provides further reliable prevention of the excessive heating due to the presence or absence of a wrap film or the differences in the manner of wrapping the food 2 in a wrap film. Furthermore, the maximum output power limit value may be varied in accordance with the weight of the food 2. For example, the limit value may be rendered smaller with decrease in the weight of the food, or the limit value may be rendered larger with increase in the weight of the food. Consequently, the food can also be prevented from being excessively heated.

Although the discrimination of the food between the two conditions or among the three conditions is based on the humidity signal produced by the humidity sensor 16 in the foregoing embodiments, a gas sensor may be provided for detecting a gas such as steam emanating from the food 2 so that the discriminated of the food is based on a signal produced by the gas sensor, instead. Furthermore, in the foregoing embodiments, the remaining heating time is calculated in accordance with the results of discrimination when the food has been determined to be either in the first or in the second condition or in any one of the first, second and third conditions. A heating output power or output power of the magnetron may be varied in accordance with the results of discrimination, instead.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

We claim:

1. A heating apparatus comprising:

a heating chamber;

a magnetron for supplying microwaves to the heating chamber so that food accommodated in the heating chamber is heated;

detecting means for detecting an absolute humidity in the heating chamber or a gas emanating from the food;

wrap film discrimination means connected to the detecting means, to measure a time T between initiation of a heating operation and a time an output of the detecting means reaches a predetermined wrap film discrimination value for discriminating with respect to the food accommodated in the heating chamber among a first condition when the measured time T is at or below a first wrap film discrimination time T1, a second condition when the measured time T is above the first wrap film discrimination time T1 and at or below a second wrap film discrimination time T2, and a third condition when the measured time T is above the second wrap film discrimination time T2, the first and second wrap film discrimination times T1 and T2 having a relationship of inequality T1<T2, the first condition corresponding to a condition in which the food is not wrapped in a wrap film, the second condition corresponding to a condition in which the food is wrapped in a warp film in such an incomplete manner that a gas emanating from the food is likely to leak outside the wrap film, the third condition corresponding to a condition in which the food is completely wrapped in a wrap film; and control means connected to the magnetron, the detecting means and the wrap film discrimination means, for controlling the magnetron to thereby control a heating operation, the control means having a function of executing the heating operation according to any one of the first to third conditions of the food discriminated by the wrap film discrimination means after the magnetron is driven so that the heating operation is initiated.

2. A heating apparatus according to claim 1, further comprising remaining heating time calculating means for calculating a remaining heating time in accordance with any one of the first, second, and third conditions of the food determined by the wrap film discrimination means the remaining heating time in accordance with the first condition being longest of the three, the remaining heating time in accordance with the third condition being shortest of the three, the remaining heating time in accordance with the second condition being intermediate between the remaining heating times in accordance with the first and third conditions.

3. A heating apparatus according to claim 1, further comprising time setting means for setting an excessive heating preventing heating time for preventing the food from being excessively heated.

4. A heating apparatus according to the claim 3, further comprising weight detecting means for detecting a weight of the food, or weight data inputting means for inputting data indicative of the weight of the food, and wherein the time setting means sets the excessive heating preventing heating time in accordance with the weight of the food detected by the weight detecting means or the data indicative of the weight of the food inputted by the weight data inputting means.

5. A heating apparatus according to claim 1, wherein the detecting means comprises a humidity sensor for detecting an absolute humidity in the heating chamber or a gas sensor for detecting the gas emanating from the food.

6. A heating apparatus according to claim 5, wherein an output of the humidity sensor or the gas sensor is input in a period during which a drive voltage is not applied to the magnetron.

7. A heating apparatus according to claim 6, wherein the output of the humidity sensor or the gas sensor is input at a plurality of times in the period during which the drive voltage is not applied to the magnetron, and a mean value of the input outputs is obtained.

8. A heating apparatus according to claim 1, further comprising means for measuring a measurable time $T_\alpha$ between the initiation of the heating operation and a time an output of the detecting means reaches a remaining heating time calculating set value $\alpha$ and remaining heating time calculating means for calculating a remaining heating time by multiplying the measurable time $T_\alpha$ by one of three remaining heating time calculating constants $\beta 1$, $\beta 2$, and $\beta 3$ corresponding to the first, second, and third conditions of the food respectively, and which are set to effect the relation shown by $\beta 3<\beta 2<\beta 1$.

9. A heating apparatus according to claim 1, further comprising means for measuring a measurable time $T\alpha$ between start of the heating operation and a time an output of the detecting means reaches a remaining heating time calculating set value $\alpha$ and remaining heating time calculating means for calculating a remaining heating time by multiplying the measurable time $T_\alpha$ by a remaining heating time calculating constant $\beta$, and wherein the remaining heating time calculating constant $\beta$ is varied in accordance with the measurable time $T_\alpha$.

10. A heating apparatus according to claim 1, further comprising operation control means for terminating the heating operation when an output produced by the detecting means has reached a maximum output limit value, and wherein the maximum output limit value is varied in accordance with the results of discrimination by the wrap film discrimination means.

11. A heating apparatus comprising:

a heating chamber;

a magnetron for supplying microwaves to the heating chamber so that food accommodated in the heating chamber is heated;

detecting means for detecting an absolute temperature in the heating chamber or a gas emanating from the food, thereby producing an output;

wrap film discrimination means, connected to the detecting means, for discriminating with respect to the food accommodated in the heating chamber among a first condition when the output of the detecting means is at or above a first wrap film discrimination value when a set time has elapsed from initiation of a heating operation, a second condition when the output of the detecting means is below the first wrap film discrimination value and at or above a second wrap film discrimination value when the set time has elapsed from the initiation of the heating operation, and a third condition when the output of the detecting means is below the second wrap film discrimination value when the set time has elapsed from the initiation of the heating operation, the first wrap film discrimination value being larger than the second wrap film discrimination value, the first condition corresponding to a condition in which the food is not wrapped in a wrap film, the second condition corresponding to a condition in which the food is wrapped in a wrap film in such an incomplete manner that a gas emanating from the food is likely to leak outside the wrap film, the third condition corresponding to a condition in which the food is completely wrapped in a wrap film; and control means connected to the magnetron and the wrap film discrimination means, for controlling the magnetron to thereby control a heating operation, the control means having a function of executing the heating operation according to any one of the first to third conditions of the food discriminated by the wrap film discrimination means after the magnetron is driven so that the heating operation is initiated.

* * * * *